US012497882B2

(12) United States Patent
Steele et al.

(10) Patent No.: US 12,497,882 B2
(45) Date of Patent: Dec. 16, 2025

(54) FLOW DIVERTER AND SEPARATOR FOR DOWNHOLE SEPARATION IN A MULTI-BORE WELL

(71) Applicant: Halliburton Energy Services, Inc., Houston, TX (US)

(72) Inventors: David J. Steele, Carrollton, TX (US); Matthew Bradley Stokes, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/648,824

(22) Filed: Apr. 29, 2024

(65) Prior Publication Data

US 2025/0101848 A1 Mar. 27, 2025

Related U.S. Application Data

(60) Provisional application No. 63/585,691, filed on Sep. 27, 2023.

(51) Int. Cl.

| | |
|---|---|
| ***E21B 43/38*** | (2006.01) |
| ***E21B 41/00*** | (2006.01) |
| ***E21B 43/34*** | (2006.01) |

(52) U.S. Cl.

CPC ..... *E21B 43/38* (2013.01); *E21B 41/0035* (2013.01); *E21B 43/35* (2020.05)

(58) Field of Classification Search

CPC ..... E21B 43/12; E21B 43/121; E21B 43/35; E21B 43/36; E21B 43/38; E21B 43/385;

(Continued)

(56) References Cited

U.S. PATENT DOCUMENTS

| | | | |
|---|---|---|---|
| 4,771,830 | A | 9/1988 | Peate |
| 5,107,927 | A | 4/1992 | Whiteley et al. |

(Continued)

FOREIGN PATENT DOCUMENTS

| | | |
|---|---|---|
| CN | 102235162 | 11/2011 |
| CN | 112240194 | 1/2021 |

(Continued)

OTHER PUBLICATIONS

"BaraCRI™ Cuttings Reinjection Operations Save More Than US 4 Million on Six-Year Project", Halliburton, www.halliburton.com, 2018, 2 pages.

(Continued)

*Primary Examiner* — Daniel P Stephenson

(74) *Attorney, Agent, or Firm* — DeLizio, Peacock, Lewin & Guerra LLP

(57) ABSTRACT

A system for downhole separation of at least one of fluids or solids comprises a fluid flow diverter to be positioned downhole in a well. The fluid flow diverter is configured to receive a formation fluid in a multilayer flow structure that comprises a production fluid and a nonproduction fluid, wherein the fluid flow diverter is configured to separate the production fluid and the nonproduction fluid by being adjusted such that more of the production fluid is above the fluid flow diverter than below the fluid flow diverter and such that more of the nonproduction fluid is below the fluid flow diverter than above the fluid flow diverter.

33 Claims, 24 Drawing Sheets

(58) Field of Classification Search
CPC . E21B 41/0035; B01D 17/02; B01D 17/0217; B01D 2221/04
See application file for complete search history.

(56) References Cited

U.S. PATENT DOCUMENTS 5,165,450 A 11/1992 Marrelli et al.
5,295,537 A 3/1994 Trainer
5,314,018 A 5/1994 Cobb
5,564,509 A 10/1996 Dietzen
5,597,042 A 1/1997 Tubel et al.
5,613,242 A 3/1997 Oddo
5,673,752 A 10/1997 Scudder et al.
5,690,708 A 11/1997 Danckaarts et al.
5,711,374 A 1/1998 Kjos
5,762,149 A 6/1998 Donovan et al.
5,837,152 A 11/1998 Komistek
5,996,690 A 12/1999 Shaw et al.
6,082,452 A 7/2000 Shaw et al.
6,089,317 A 7/2000 Shaw
6,092,599 A 7/2000 Berry et al.
6,131,660 A 10/2000 Stuebinger et al.
6,170,580 B1 1/2001 Reddoch
6,179,071 B1 1/2001 Dietzen
6,189,613 B1 2/2001 Chachula et al.
6,213,208 B1 4/2001 Skilbeck
6,277,286 B1 8/2001 Sontvedt et al.
6,336,504 B1 * 1/2002 Alhanati ..... E21B 43/122 166/372
6,378,608 B1 4/2002 Nilsen et al.
6,394,183 B1 5/2002 Schrenkel et al.
6,719,048 B1 4/2004 Ramos et al.
6,755,978 B2 6/2004 Oddie et al.
7,017,663 B2 3/2006 Polderman et al.
7,971,657 B2 7/2011 Hollier et al.
8,286,805 B2 10/2012 Hopper
8,505,627 B2 8/2013 Cox
8,950,510 B2 2/2015 Bender
9,289,700 B2 3/2016 Andreussi et al.
9,334,699 B2 5/2016 Bender et al.
9,359,878 B2 6/2016 Whitney et al.
9,441,435 B2 9/2016 Leitch
10,323,494 B2 6/2019 Joshi et al.
10,344,570 B2 7/2019 Steele et al.
10,583,373 B2 3/2020 Braaten et al.
10,626,682 B2 4/2020 Hope et al.
10,767,477 B1 9/2020 Leeper et al.
10,844,699 B2 11/2020 Xiao et al.
11,008,848 B1 5/2021 Webber et al.
11,103,807 B2 8/2021 Oneto et al.
11,143,009 B1 10/2021 Novak et al.
11,173,427 B2 11/2021 Bayati et al.
11,180,396 B2 11/2021 Andreussi et al.
11,285,405 B2 * 3/2022 Johnson ..... B01D 17/0217
11,643,916 B2 5/2023 Gonzales et al.
11,668,166 B2 6/2023 Lopez De Cardenas et al.
11,708,746 B1 7/2023 Xiao et al.
11,828,153 B2 11/2023 Moraes et al.
11,913,322 B1 2/2024 Aleid et al.
12,006,816 B2 6/2024 Al-dhafeeri et al.
12,305,498 B2 5/2025 Fripp et al.
2002/0059866 A1 5/2002 Grant et al.
2002/0153326 A1 10/2002 Oddie
2003/0098799 A1 5/2003 Zimmerman
2003/0205522 A1 11/2003 Polderman et al.
2004/0118565 A1 6/2004 Crawford
2006/0037746 A1 2/2006 Wright et al.
2009/0242490 A1 10/2009 Hopper
2010/0300684 A1 12/2010 Kotsonis et al.
2011/0000675 A1 1/2011 Hackworth et al.
2011/0079388 A1 4/2011 Cox
2012/0006543 A1 1/2012 Cox et al.
2012/0043088 A1 * 2/2012 McAllister ..... E21B 43/385 166/325
2012/0080186 A1 4/2012 Reed
2012/0285680 A1 11/2012 Kumar
2013/0092382 A1 * 4/2013 Dykstra ..... E21B 34/08 166/321
2013/0112598 A1 5/2013 Culver
2013/0292327 A1 11/2013 Andreussi et al.
2013/0312955 A1 11/2013 Medoff
2013/0313200 A1 11/2013 Andreussi et al.
2014/0014358 A1 1/2014 Leitch
2014/0332391 A1 11/2014 Munisteri
2015/0075772 A1 3/2015 Saponja et al.
2015/0152715 A1 6/2015 Cunningham et al.
2015/0306520 A1 10/2015 Grave et al.
2015/0345264 A1 12/2015 Johnson
2016/0047176 A1 2/2016 Martin
2017/0009557 A1 1/2017 Harman et al.
2017/0022797 A1 1/2017 Joshi et al.
2017/0058659 A1 3/2017 El-Bakry et al.
2017/0174530 A1 6/2017 Yin et al.
2017/0234113 A1 8/2017 Steele
2018/0002995 A1 1/2018 Dotson et al.
2018/0051533 A1 2/2018 Zbranek et al.
2018/0100383 A1 * 4/2018 Saponja ..... E21B 34/107
2018/0223642 A1 8/2018 Zahran
2018/0320500 A1 11/2018 Williams
2019/0032465 A1 1/2019 Ayub
2019/0145220 A1 5/2019 Patel et al.
2019/0186222 A1 6/2019 Steele et al.
2019/0203575 A1 7/2019 Schlosser
2019/0323331 A1 10/2019 Zahran
2020/0123888 A1 * 4/2020 Saponja ..... B01D 19/0042
2020/0215459 A1 7/2020 Oneto et al.
2020/0217187 A1 7/2020 Wang et al.
2020/0378235 A1 12/2020 Gonzales et al.
2021/0055146 A1 2/2021 Bukhamseen et al.
2021/0115771 A1 4/2021 Berntsen et al.
2021/0140297 A1 5/2021 Webber et al.
2021/0363836 A1 11/2021 Jandhyala et al.
2021/0379511 A1 12/2021 Scott et al.
2022/0034178 A1 2/2022 Hughes
2022/0049581 A1 2/2022 Provost et al.
2022/0056799 A1 2/2022 Johnson et al.
2022/0220838 A1 7/2022 Capela Moraes et al.
2022/0282695 A1 9/2022 Peviani
2023/0109781 A1 4/2023 Alexander et al.
2023/0175364 A1 6/2023 Al-huwaider et al.
2024/0076953 A1 3/2024 Trifol et al.
2024/0084687 A1 3/2024 Saponja et al.
2025/0067150 A1 2/2025 Shakeel et al.
2025/0067160 A1 2/2025 Shukor et al.
2025/0067164 A1 2/2025 Gupta et al.
2025/0084748 A1 3/2025 Fripp et al.
2025/0101817 A1 3/2025 Steele et al.
2025/0101822 A1 3/2025 Steele et al.
2025/0101823 A1 3/2025 Steele
2025/0101846 A1 3/2025 Steele et al.
2025/0101849 A1 3/2025 Steele et al.
2025/0109674 A1 4/2025 Donovan et al.
2025/0109675 A1 4/2025 Steele et al.
2025/0109676 A1 4/2025 Butler et al.
2025/0154860 A1 5/2025 Steele et al.

FOREIGN PATENT DOCUMENTS

CN 116733440 9/2023
CN 117552765 2/2024
CN 117569792 2/2024
CN 118057000 5/2024
EP 0977621 7/2002
EP 0948702 3/2003
JP 2002370005 12/2002
WO 1992009379 6/1992
WO 1996004056 2/1996
WO 2004007908 1/2004
WO 2010118351 10/2010
WO 2011119675 9/2011
WO 2014172324 10/2014
WO 2025071675 4/2025
WO 2025071676 4/2025
WO 2025071677 4/2025

(56) References Cited

FOREIGN PATENT DOCUMENTS

| | | |
|---|---|---|
| WO | 2025071678 | 4/2025 |
| WO | 2025071679 | 4/2025 |
| WO | 2025071680 | 4/2025 |
| WO | 2025071682 | 4/2025 |
| WO | 2025071683 | 4/2025 |
| WO | 2025071684 | 4/2025 |
| WO | 2025106689 | 5/2025 |

OTHER PUBLICATIONS

"BaraCRI™ Cuttings Reinjection System Saves Operator USD 120,000 Per Month", Halliburton, www.halliburton.com, 2018, 2 pages.
"BaraCRI™ Services Help Reduce Environmental Impact in First CRI Application in Ecuador", Halliburton, www.halliburton.com, 2018, 2 pages.
"Cuttings Reinjection Video", SLB; https://www.slb.com/videos/cuttings-reinjection-service, Sep. 8, 2016, 4 pages.
"iWISE: Integrated waste injection services", Mi SWACO: a Schlumberger Company, 2016, 6 pages.
"Whirlaway Gas Handlers", ChampionX Artificial Lift, Nov. 4, 2020, 2 pages.
"Workstring Orientation Tool: Orientation Accuracy in Multilateral Completion Operations", Halliburton Completion Tools, 2020, 2 pages.
Alshmakhy, et al., "Use of Downhole Oil-Water Separation System in Horizontal Wells", 2021 SPE Annual Technical Conference and Exhibition, Sep. 2021, 5 pages.
Catala, "Fluid Flow Fundamentals", Oilfield Review, 1996, 4 pages.
Ezell, et al., "First Successful Field Utilization of Cuttings Re-Injection (CRI) in the Offshore Field of Saudi Arabia as an Environmentally Friendly and Cost Effective Waste Disposal Method", SPE Annual Technical Conference and Exhibition held in Denver, Colorado, USA, Nov. 2011, 14 pages.
Guo, et al., "Increased Assurance of Drill Cuttings Reinjection: Challenges, Recent Advances, and Case Studies", Paper IADC/SPE 87972 presented at the IADC/SPE Asia PacificDrilling Technology Conference and Exhibition, Jun. 2007, 7 pages.
Hagan, et al., "Engineering and Operational Issues Associated with Commingled Drill Cuttings and Produced Water Re-injection Schemes", SPE International Conference on Health, Safety and Environment in Oil and Gas Exploration and Production held in Kuala Lumpur, Malaysia, Mar. 2022, 9 pages.
Hernandez, et al., "Drill Cutting Reinjection Feasibility Study in a Critical Environment, Apaika Field, Ecuador", SPE Latin American and Caribbean Health, Safety, Environment and Sustainability Conference held in Bogotá, Colombia, Jul. 2015, 21 pages.
Kuhnen, et al., "Destabilizing Turbulence in Pipe Flow", Nature Physics vol. 14, 386-390 (2018), 2018, 36 pages.
Kuhnen, et al., "Like Cures Like: How to Destroy Turbulence With Turbulence", APS Physics; YouTube Video https://youtu.be/gZgtT-JxmtM?si=zBHluksDm75LCQuw, Nov. 14, 2017.
Ladmia, et al., "Downhole Oil Water Separation to Handle Produced Water Study Case Onshore & Offshore Fields Abu Dhabi", SPE Annual Technical Conference and Exhibition, Dubai, UAE, Sep. 2021, Sep. 15, 2021.
Marusic, et al., "An Energy-Efficient Pathway to Turbulent Drag Reduction", Nature Communications vol. 12, Article No. 5805 (2021), 2021, 8 pages.
McCoy, et al., "Evaluation and Performance of Packer-Type Downhole Gas Separators", SPE Production and Operations Symposium, Mar. 2023, 14 pages.
Muktadir, et al., "Review and Applicability of Downhole Separation Technology", 2016, 13 pages.
Poclin, et al., "Commingled Reinjection of Cuttings and Produced Water Provides a Zero-Discharge Solution for the Development Phase of the Pirana Field in the Peruvian Amazon Region", SPE Latin American and Caribbean Petroleum Engineering Conference held in Quito, Ecuador, Nov. 2015, 18 pages.
Samy, "Cutting Re-injection CRI Uncertainty and Risk Assessment", SPE Abu Dhabi International Petroleum Exhibition & Conference to be held in Abu Dhabi, UAE,, Nov. 2021, 15 pages.
Scarselli, et al., "Turbulence Suppression by Cardiac-Cycle-Inspired Driving of Pipe Flow", Nature vol. 621, pp. 71-74 (2023), Sep. 6, 2023.
Schuh, et al., "Case History: Cuttings Reinjection on the MurdochDevelopment Project in the Southern Sector of the North Sea", Paper SPE 26680 presented at the Offshore European Conference held in Aberdeen, 1993, 16 pages.
Yang, et al., "Application of DOWS (Downhole Oil Water Separation) Technology Used in High Water-Cut Oilfield: Case Study", SPE/IATMI Asia Pacific Oil & Gas Conference and Exhibition, Oct. 2015, 8 pages.
Zunce, et al., "Study on the Flow Pattern of Downhole Oil-Water Separator with Different Inlet Patterns", 2009 3rd International Conference on Bioinformatics and Biomedical Engineering, Jun. 2009, 4 pages.
"PCT Application No. PCT/US2024/026360 International Search Report and Written Opinion", Aug. 19, 2024, 13 pages.
"PCT Application No. PCT/US2024/026689 International Search Report and Written Opinion", 13 pages.
"PCT Application No. PCT/US2024/026896 International Search Report and Written Opinion", Aug. 19, 2024, 13 pages.
"PCT Application No. PCT/US2024/026900 International Search Report and Written Opinion", Aug. 19, 2024, 12 pages.
"PCT Application No. PCT/US2024/027103 International Search Report and Written Opinion", Aug. 19, 2024, 11 pages.
"PCT Application No. PCT/US2024/027105 International Search Report and Written Opinion", Oct. 10, 2024, 11 pages.
"PCT Application No. PCT/US2024/027565 International Search Report and Written Opinion", Sep. 6, 2024, 14 pages.
"PCT Application No. PCT/US2024/027573 International Search Report and Written Opinion", Sep. 9, 2024, 11 pages.
"PCT Application No. PCT/US24/28078 International Search Report and Written Opinion", Aug. 14, 2024, 9 pages.
"PCT Application No. PCT/US2024/055948 International Search Report and Written Opinion", Mar. 7, 2025, 13 pages.
"U.S. Appl. No. 18/646,388 Non-Final Office Action", Jan. 30, 2025, 11 pages.
"U.S. Appl. No. 18/647,015 Restriction Requierement", Jan. 22, 2025, 7 pages.
"U.S. Appl. No. 18/647,581 Restriction Requirement", Feb. 5, 2025, 7 pages.
"U.S. Appl. No. 18/656,389 Restriction Requirement", Feb. 5, 2025, 7 pages.
"U.S. Appl. No. 18/945,016 Non-Final Office Action", Jul. 22, 2025, 10 pages.
"U.S. Appl. No. 18/653,061 Final Office Action", Jul. 3, 2025, 20 pages.
"U.S. Appl. No. 18/647,581 Non-Final Office Action", Apr. 22, 2025, 17 pages.
"U.S. Appl. No. 18/647,015 Non-Final Office Action", Jun. 4, 2025, 19 pages.
"U.S. Appl. No. 18/647,393 Non-Final Office Action", Apr. 7, 2025, 21 pages.
"U.S. Appl. No. 18/649,236 Non-Final Office Action", May 13, 2025, 13 pages.
"U.S. Appl. No. 18/651,918 Non-Final Office Action", Jun. 4, 2025, 15 pages.
"U.S. Appl. No. 18/653,061 Non-Final Office Action", Mar. 18, 2025, 16 pages.
"U.S. Appl. No. 18/656,389 Non-Final Office Action", Apr. 24, 2025, 20 pages.

* cited by examiner

FLOW DIVERTER AND SEPARATOR FOR DOWNHOLE SEPARATION IN A MULTI-BORE WELL

BACKGROUND

Oil and gas wells produce significant amounts of water in their lifetime. The percentage of water produced from these wells is called the water cut, the ratio of the water produced from the well compared to the volume of the total liquids produced. Most wells produce an ever-increasing water cut throughout their productive life. In many oil fields around the world the percentage of water recovered with oil has risen to be greater than the percentage of the oil. In fact, in many fields, the percentage of oil has decreased to be from about 20% in an excellent field to about 2% in a relatively poor field.

The end of a well's productive life is often determined by the water cut. A well is typically shut in when the value of the hydrocarbons produced is no longer sufficient to economically cover the operating costs of the well and the cost of disposing of the produced water. Indeed, disposing of the produced water is not environmentally and economically friendly as energy is used to power the pump to lift the produced water to the surface, to separate the produced water from the oil, to transport the separated water as it cannot be disposed on the surface in most cases. Thus, the separated water must be transported to a remote well site to be reinjected into a subterranean formation. Therefore, decreasing the water cut of a well increases the value of the produced fluids and directly decreases the disposal costs of the produced water.

One method of reducing the water cut of a well is to separate produced water from the hydrocarbons downhole, rather than at surface. Downhole separation increases the value of the fluids produced to the surface. Downhole separation also facilitates disposal of the separated water. The separated water can be reinjected into the same production zone or into a different zone. Another way to improve the productivity of a well is to increase the length of the intersection of the productive zone by the well completion. One way of increasing this intersection length is by using multi-bore or multilateral wells. Such wells may be conventional wells that have a lateral well that is drilled from a point in the original well. The lateral well increases productivity by allowing additional intersection length along the productive zone without the cost and delay involved in redrilling the upper part of the well. While multilaterals enable multiple intersections within the same productive zone, multilaterals also enable fluid communication with different productive zones or in other zones that are not defined as productive zones (e.g., water injection zones, depleted productive zones, etc.) within a reservoir. In certain reservoirs, operators can leverage this approach to improve reservoir production by accessing numerous production zones or by increasing the contact area between a wellbore and a formation with minimal increase in drilling and completion costs. These techniques also reduce the environmental footprint of drilling rigs and subsequent production trees, particularly for land operations. Therefore, the use of multilateral well increases the potential production of a well and can also enable disposal of the produced water in a different zone.

BRIEF DESCRIPTION OF THE DRAWINGS

Embodiments of the disclosure may be better understood by referencing the accompanying drawings.

DESCRIPTION

Figure 1:
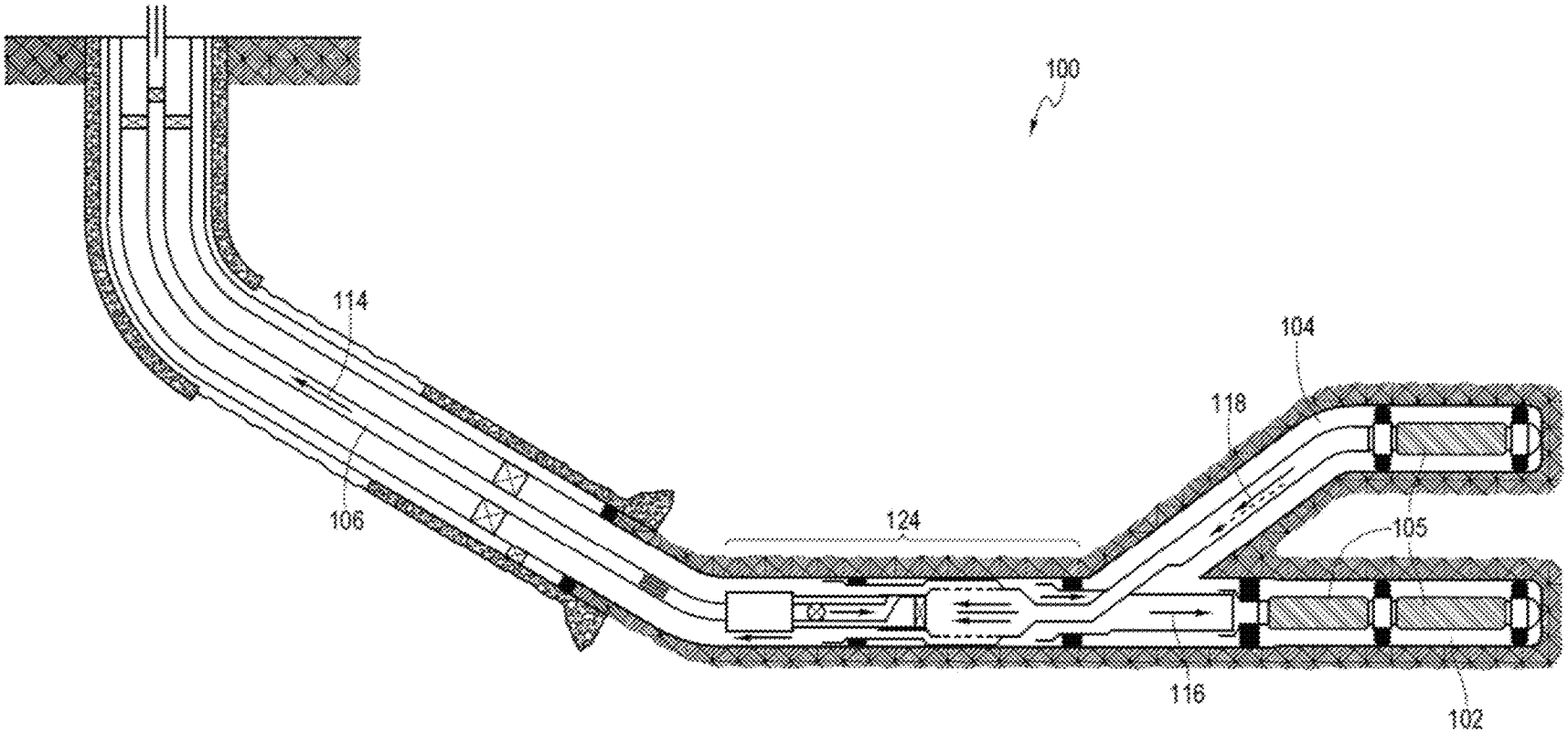
FIG. 1 is a perspective view in partial cross section of a multilateral well system that includes downhole fluid separation, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Some implementations are in reference to a "multilateral well" and "multi-bore well." Such terms may be used interchangeably. In other words, a multilateral well may be defined to include any type of well have more than one bore, wellbore, branch, lateral, etc. For example, a multilateral well may include a main bore with one or more laterals branching therefrom. In another example, a multilateral well may also include any type of multi-bore well configuration with such bores at any angles relative to each other. Also, the terms Downhole Oil-Water Separation (DOWS) System and Downhole Oil-Water-Solids Separation (DOWSS) System herein may be used interchangeably. Moreover, the acronyms DOWS and DOWSS herein may be used interchangeably.

Example implementations may include a wellbore system that includes a downhole fluid diverter. For example, the system may be part of a multilateral well completion that includes a fluid diverter at or near a junction between the main bore and a lateral well on the upper completion. A fluid diverter may provide separation of different types of fluids. For example, the fluid diverter may separate a formation fluid (received from the formation surrounding on the main bore) into production fluid and nonproduction fluid. For instance, the fluid diverter may include an oil and water diverter and a gas, oil, and water diverter, etc. In some implementations, the system may include a pump (such as an electrical submersible pump (ESP)) at the junction to pump the nonproduction fluid (such as water) into the lateral well so that the nonproduction fluid is injected into the subsurface formation surrounding the lateral well.

Production of water with oil increases the "lifting" and production costs of an oil well. As wells get older, the wells often begin to produce more water. To decrease the lifting and production cost related to produced water, Downhole Oil-Water Separation (DOWS) operations may be implemented to separate the water downhole and inject such water into another portion of the well. This may include disposing of the separated produced water into one or more legs of a multilateral well.

In horizontal wells, the formation fluid may separate into at least two different immiscible phases with a mixing layer in between leads to what is called a flow structure. Example implementations may address the problem of efficiently separating the formation fluid into a nonproduction fluid (such as water) from the production fluid (such as hydrocarbons (e.g., oil)) downhole. By taking advantage of the 2-layer flow structure, most of the separation process may be handled by taking advantage of the naturally occurring 2-layer flow structure. Example implementations may include a configurable (controllable) downhole to separate a production fluid into a production fluid and a nonproduction fluid.

The one or more diverters may be self-adjusting (such as respond or adjust position, inclination, orientation, shape, composition, etc.) via external and/or internal parameters. For example, changes may be made when the fluid composition changes (such as an increase in water-cut), when the flow rate changes, when one or more flow streams change (such as oil-cut stream and water-cut stream), when the density of one or more fluids changes, when temperature, pressure, resistance, electrical conductivity, salinity, fluid composition, gas content, solids content, pH, buoyancy, viscosity, radiation level (natural radiation or radiation from a tracer or other device). The one or more diverters may be self-adjusting and remotely adjustable (such as from a control signal). Other device(s) located near a diverter may be adjusted in concert with the diverters. One or more diverters may be automatic, semi-automatic, comprise over-ride features (such as from a control signal), etc. Other device(s) located near a diverter or related to the performance of the diverters, may be self-controlled, and/or have automatic, semi-automatic, and comprise over-ride features.

Example System

FIG. 1 is a perspective view in partial cross section of a multilateral well system that includes downhole fluid separation, according to some embodiments. FIG. 1 depicts a multilateral well that includes a main bore 102 and a lateral bore 104. The main bore 102 may include an open hole horizontal well. The lateral bore 104 may be an open hole inclined well. Screens 105 may be positioned in the main bore 102 and the lateral bore 104. For example, one of the screens 105 may be positioned in the lateral bore 104 at the point where the formation fluid 118 enters the tubing to prevent the larger solids from even entering the tubing. While described as being screens, alternatively or in addition, slotted liners, perforated tubing, etc. may be used to prevent the larger solids from entering the tubing.

Figure 2:
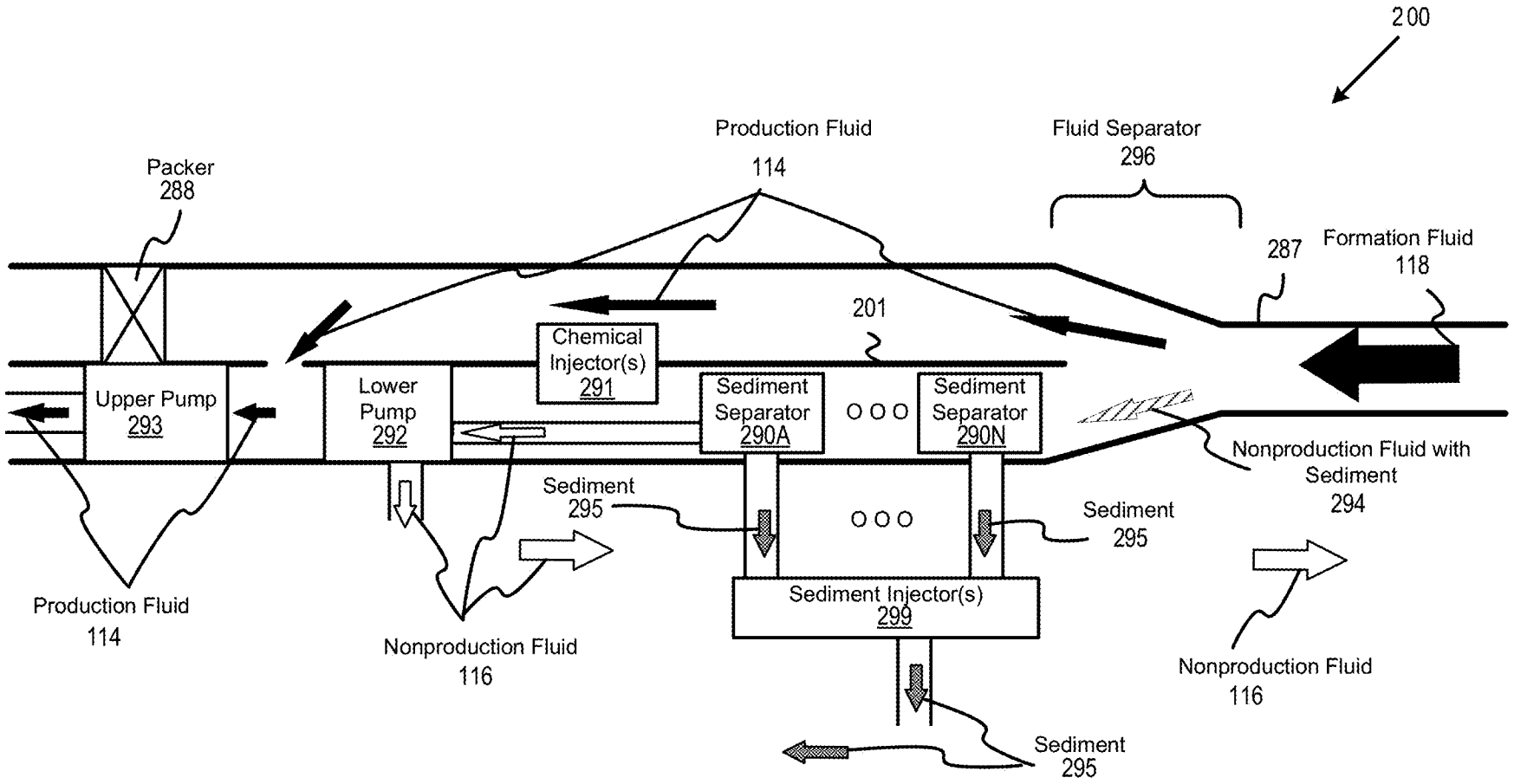
FIG. 2 is a cross-sectional side view of an example downhole separation system (including fluid separator(s), sediment separator(s), and sediment injector(s)), according to some embodiments.

In FIG. 1, a system 100 includes a separation system 124 that may include a combination of separators for both fluid and solids (such as sediment). The separation system 124 may include pumps and sediment injectors. An example of the separation system 124 is depicted in FIG. 2 (which is further described below). A formation fluid 118 from the lateral bore may be drawn into the separation system 124. The separation system 124 may include at least one a fluid separator to separate the formation fluid 118. For example, the separation system 124 may include a high-water cut separator to separate the majority of water and then the hydrocarbon stream may have a second low-water cut separator. gas separator may be included in the hydrocarbon stream or other location. The fluid separator may separate the formation fluid 118 into a production fluid (such as hydrocarbons (e.g., oil)) 114 and a nonproduction fluid (such as water) 116. The production fluid 114 may be delivered uphole through a production tubing 106. The nonproduction fluid 116 may be delivered to the main bore 102 for injecting into the surrounding formation. Thus, example implementations may separate the nonproduction fluid downhole such that the nonproduction fluid may be directed back to the formation (or any other formation (such as a non-productive formation) without any need to pump it to the surface for separation and any transportation needed for storage.

The nonproduction fluid 116 may include sediment. In some implementations, the sediment may be separated out from the nonproduction fluid 116 prior to the nonproduction fluid 116 being injected back into a subsurface formation. Therefore, the separation system 124 may also include sediment separator(s) to separate out sediment from the nonproduction fluid 116.

In some implementations, the sediment that has been separated out may be stored downhole (at least temporarily). In some implementations, the sediment may be delivered to the surface of the multilateral well or another downhole location using a flow channel (such as a tubing string). Examples of another downhole location may include a cavern, a disposal wellbore, a thief zone, etc. This flow channel may be the production tubing string 106 used to deliver production fluid to a surface of the multilateral well. In some implementations, this flow channel may be a separate tubing string for delivery of the sediment and/or other fluids to the surface of the multilateral well or to a different downhole location. In some implementations, the sediment and/or other fluids may be injection at a different location, wellbore, storage device, etc. on the sea floor.

In some implementations, the separation system 124 may include sediment injector(s) to receive the sediment separated out by the sediment separator(s). The sediment injector(s) may inject this sediment into the production tubing string 106 (used to deliver the production fluid to a surface of the multilateral well) to deliver this sediment to the surface of the multilateral well. Alternatively or in addition, the sediment injector(s) may inject this sediment into a separate tubing string to deliver this sediment to the surface of the multilateral well or to a different location.

FIG. 2 is cross-sectional side view of an example downhole separation system (including a fluid separator(s), sediment separator(s), and sediment injector(s)), according to some embodiments. For example, FIG. 2 depicts a separation system 200 that may be an example of the separation system 124 depicted in FIG. 1. The separation system 200 includes a tubing 287 that includes a fluid separator 296, sediment separators 290A-290N, chemical injector(s) 291, a lower pump 292, an upper pump 293, sediment injector(s) 299, a separator 201, a packer 288, and a computer/controller 270. Also, while the separation system 200 is depicted in a given order, example implementations include a separation system with components that are reordered or changed (such as additions or deletions).

The formation fluid 118 flows into the fluid separator 296. In this example, the fluid separator 296 comprises a gravity-based separation that includes the separator 201. As shown, the formation fluid 118 moves from a smaller to a larger diameter of the tubing 287. The tubing 287 is shown as one continuous tubing for ease of clarification. However, in some implementations, the tubing 287 may comprise one or more devices with different configurations. For example, with reference to FIG. 17 (which is further described below), the tubing 287 may be connected to 1770 or the Level 5 "steel" junction. In some implementations, the larger diameter of the tubing 287 may be a part of the tubing String 106 shown in FIG. 1. In some implementations, the larger diameter of the tubing 287 may be part of an intermediate tubing string disposed between the tubing string 106 and the tubulars conducting fluid from the lateral leg—see FIG. 19 (which is further described below), where the tubulars are conducting fluid from the lateral leg or the string(s) (fluid 1908) and being pumped through to arrive into 1902.

This may decrease the velocity of the flow of the formation fluid 118—which allows the separation. In particular, most or at least a majority of the production fluid 114 may separate into a flow above the separator 201, while most or at least a majority of the nonproduction fluid with sediment 294 may separate into a separate flow below the separator 201. This allows most of the sediment to be captured in the lower portion of the tubing 287 (below the separator 201).

While depicted as having the separator 201, in some implementations, there is no separator 201. Rather, the production fluid 114 and the nonproduction fluid with sediment 294 may naturally separate in a horizontal pipe because of their different density. Accordingly, even in a same tubing without the separator 201, most of the production fluid 114 would be above the nonproduction fluid 116 because of the differences in weight (density) between the two types of fluid.

The nonproduction fluid with sediment 294 flows into the sediment separators 290A-290N, which may represent one to any number and type of sediment separators. In some implementations, each of the sediment separators 290A-290N may separate some of the sediment in the nonproduction fluid with sediment 294. For example, the first sediment separator 290 may be used to separate and collect the largest size (denser) sediment; the second sediment separator 290 may be used to separate and collect the next largest size sediment; the third sediment separator 290 may be used to separate and collect the next largest size sediment; etc. (as the flow moves from right to left through the different sediment separators). For example, at least one of the sediment separators 290 may be a cyclonic separator—wherein larger (denser) particles in the rotating stream having too much inertia to follow the tight curve of the stream. Such particles may thus strike the outside wall and fall to the bottom of the cyclone where they may be removed. In some implementations, each of the sediment separators 290 may store the sediment that was collected into an associated storage area or tank.

Additionally, the chemical injector(s) 291 may inject one or more chemicals into at least one of the formation fluid 118, the production fluid 114, the nonproduction fluid with sediment 294, the nonproduction fluid 116, or the sediment 295. While depicted such that chemicals are injected downhole, alternatively or in addition, chemicals may be injected from the surface of the multilateral well. Also, different chemicals may be injected for different purposes. For example, a flocculant or deflocculant may be injected to promote or not promote aggregation or settling of suspended particles in a liquid. Other examples of chemicals being injected may include paraffin, solvents, dispersants, etc. being added to the production fluid 114, a scavenger being added to the production fluid 114 to protect components from corrosive gases ($H_2S$, CO2, etc.) therefrom, etc. In particular, crude oils often contain paraffins which precipitate and adhere to the liner, tubing, sucker rods and surface equipment as the temperature of the producing stream decreases in the normal course of flowing, gas lifting or pumping. Heavy paraffin deposits are undesirable because they reduce the effective size of the flow conduits and restrict the production rate from the well. Where severe paraffin deposition occurs, removal of the deposits by mechanical, thermal or other means is required, resulting in costly down time and increased operating costs.

In some implementations, these different collections of the sediment by the different sediment separators 290 may be injected into a same or different line or tubing for disposal. As shown, the sediment injector(s) 299 are coupled to receive the sediment collected by the different sediment separators 290.

Periodically, sediment may need to be emptied from the different sediment separators 290 via the sediment injector(s) 299. The decision of when may be based on different criteria. For example, pressure and/or production flow may be monitored at the surface of the multilateral well. If the pressure and/or production flow start to degrade, it may be an indication that sediment needs to be emptied from the sediment separators 290.

In some implementations, sensors may be coupled to each of the tanks of the sediment separators 290. A signal from a given sensor may indicate when the associated sediment separator 290 needs to be emptied. A computer/controller 270 (downhole and/or at the surface of the multilateral well) may be communicatively coupled to the sensors such that the controller may initiate a sequence to empty one or more of the tanks of the sediment separators 290.

In some implementations, the sediment injector(s) 299 may dispose of these sediments by injecting them into a tubing for delivery to the surface of the multilateral well. For example, the sediment may be delivered to the surface using the production tubing or a separate tubing. If the production tubing is used, the solids may be included with the production fluid that is being delivered to the surface. In some implementations, the production of solids with the production fluid may be timed or controlled so that the production fluid with solids may be diverted into special containers and/or processing equipment to remove the solids from the production fluid before the production fluid is funneled into the "regular" production flow. Such implementations may cut down the erosion of the normal production lines/devices caused by the intermittent solids production. In such implementations, separation operations may be performed at the surface to separate out the solids from the production fluid 114.

Accordingly, if sediment is being included with the production fluid 114 being delivered to the surface, the production fluid 114 may be delivered to surface equipment that provides for separation of the sediment. Alternatively, during the time when the sediment is not being included with the production fluid 114, the production fluid 114 may be delivered to different surface equipment that does not include such separation of sediment.

Alternatively or in addition, the sediment injectors 299 may deliver the sediment to a different downhole location (such as a different lateral well, a thief zone (having a high porosity, high permeability downhole zone that may include a low pressure), etc.). In some implementations, sediment may be disposed to different locations depending on their size. For example, for sediment having a size greater than X, such solids may be delivered to the surface of the multilateral well for disposal. For sediment having a size less than X but greater than Y, such sediment may be disposed in a first downhole location (such as a thief zone). For the remaining sediment that have a size less than Y, such solids may be disposed in a second downhole location (such as a lateral well).

Example implementations may include weir skimmers that function by allowing the oil floating on the surface of the water to flow over a weir. In some implementations, the weir skimmers may require the weir height to be adjusted. In some implementations, the weir skimmers may be such that the weir height is automatic or self-adjusting. While manually adjusted weir skimmer types may have a lower initial cost, the requirement for regular manual adjustment makes self-adjusting weir types more popular in most applications. Weir skimmers may collect water if operating when oil is no longer present. To overcome this limitation, the weir type skimmers may include an automatic water drain on the oil collection tank.

The multilateral junction may be placed above or inside the target formation. In some implementations, this configuration may be accomplished in a two-trip multilateral completion that includes a lower completion, and an upper completion that may comprise the fluid separator, a pump (such as an electrical submersible pump, rod pump, Rotaflex, etc.) and an upper packer. This simplifies the installation. This reduced complexity allows the fluid separator to be installed into existing wells, i.e., retrofitting existing wells. Further, the lateral well may be a target formation. In this implementation, the main bore passes into a target production formation and the lateral bore passes into a target injection formation which may be a separate formation from the production formation. The existing wells do not require a tangent section at the junction for the placement of the fluid separator, significantly increasing the number of oil well candidates for installation of the fluid separator according to example implementations.

Example implementations may be used in non-horizontal applications (inclined wells, extended reach wells, slant hole wells, vertical wells, S-wells, or combination thereof, etc.). In some applications, such as inclined wells, a flow diverter may be used in conjunction with other devices. The other devices may be one or more destabilizers, a gravitational separator, a non-gravitational separator, a combination of both gravitational and non-gravitational, a coalescing device, a cleaning device, another flow diverting device, a leveling device, an inclination device to monitor, sense, adjust, change the inclination of one or more devices with respect to gravity and/or the inclination of the well, an orientation device to monitor, sense, adjust, change the orientation and/or azimuthal position of one or more devices, systems etc. One or more orientation devices (powered and non-powered) may be used. Example implementations may include cartridges.

The design of the installed completion equipment may be critical for the downhole fluid separator to function as intended. By installing the fluid separators, pumps, and sediment injector(s) in the main bore at or near the junction between the main bore and the lateral bore, an existing watered out well may be re-entered, and a new lateral added. This decreases the overall cost involved in installing the separators, pumps, and sediment injector according to example implementations as compared with installing the lateral bore at the completion of the well at the beginning of the life of the well. It also decreases the risks associated with installing these devices according to example implementations in existing wells that may be poor producers and represent a smaller cost if the well is lost during the trial as compared with selecting a potential well before well completion is finished. Using these separators and injectors in a downhole setting combined with a multilateral junction may provide efficiency gains.

This includes converting poor performing wells, wherein the percentage of oil has decreased to about 2% for example, into a downhole water injector combined with a better producing well. Additional benefits include lower flow rate and pressure rating requirements, a lighter fluid column, and increased recovery. Example implementations may be particularly useful in low flow rate wells (in the 200 barrel per day range or less), which tend to be shallow, and relatively inexpensive to drill. Moderate flow rate wells, for example 500-5000 barrels of fluid per day, may also be potential candidates for incorporating example implementations. Finally, it will also be useful for most multilaterals with very high flow rate wells, up to 50,000 barrels of fluid per day, for example.

Example implementations reference a tubing string for the delivery of fluids, sediment, etc. to the surface of the multilateral well or other downhole location. However, example implementations may use any type of flow channel, conduit, etc. for such delivery. For example, one or more D-shaped tubes, called D-Tubes may be used. For instance, two D Tubes may be used to optimize the use of the inner diameter of a casing to maximize flow area. In some implementations, the sediment flow channel may be the annular space around the production flow tubing. Additionally, while depicting the separation being performed uphole relative to the junction between the main bore and the lateral well, example implementations may position the separation at any other location downhole. For instance, the separation may be performed at the junction, below the junction, etc.

Example Flow Diverters and Separators

In horizontal wells, the fluids may separate into at least two different immiscible phases with a mixing layer in between that leads to what is called a flow structure. To illustrate, FIGS. 3A-3C are side views of an exemplary two-layer flow structure in a horizontal wellbore that includes water and oil immiscible layers at total flow rates of 600, 1500, and 6000 Barrels Per Day (B/D), respectively, according to some embodiments.

Figures 3A, 3B, 3C:
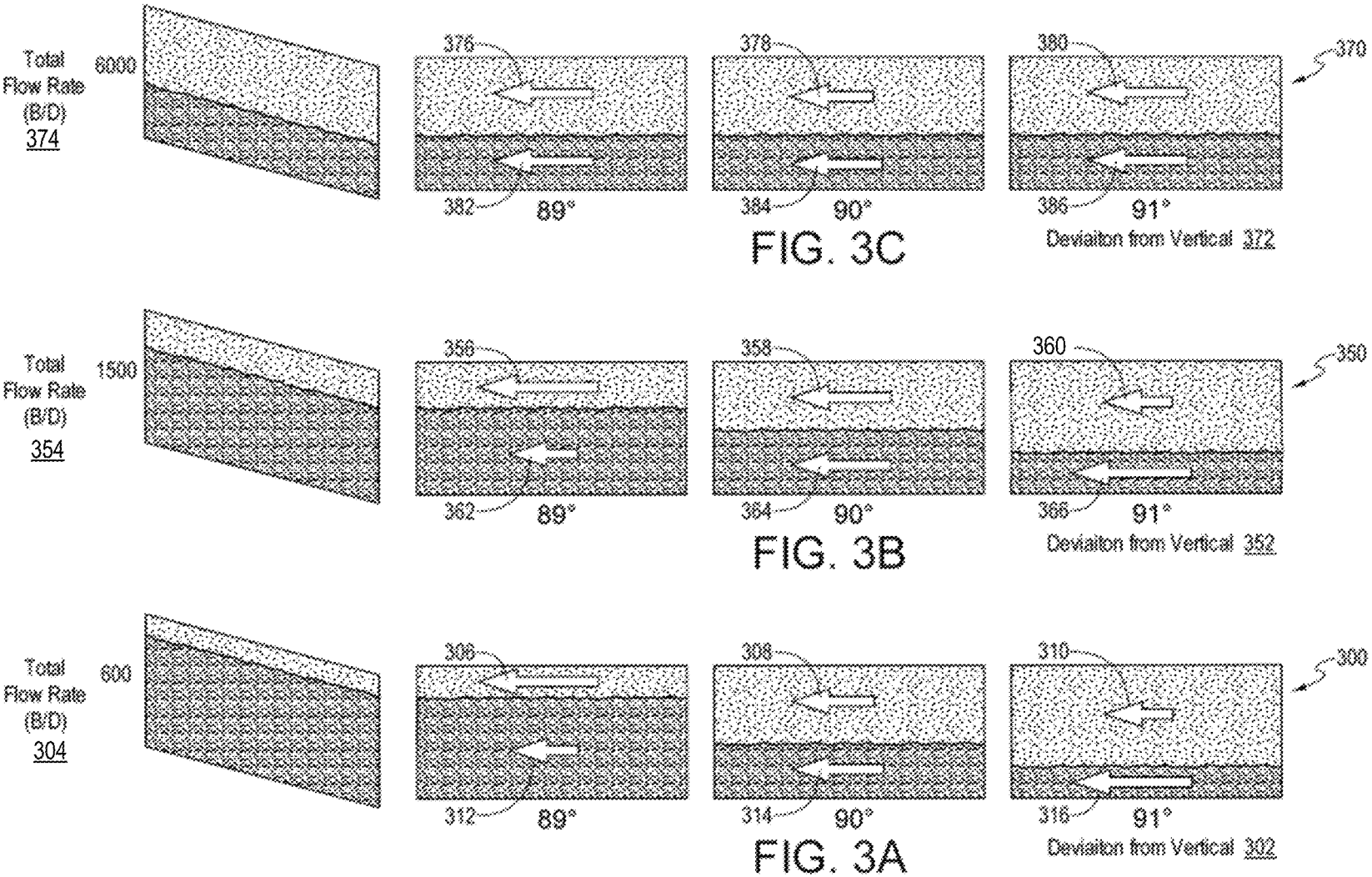
FIGS. 3A-3C are side views of an exemplary two layer flow structure in a horizontal wellbore that includes water and oil immiscible layers at total flow rates of 600, 1500, and 6000 Barrels Per Day (B/D), respectively, according to some embodiments.

FIG. 3A includes a pictorial graph 300 having a horizontal axis 302 that is a deviation from vertical and a vertical axis 304 that is the total flow rate. FIG. 3A depicts three example two-layer flow structures for a total flow rate of 600 B/D. A first example two-layer flow structure of FIG. 3A includes a production fluid 306 and a nonproduction fluid 312 at an angle of 89°. A second example two-layer flow structure of FIG. 3A includes a production fluid 308 and a nonproduction fluid 314 at an angle of 90°. A third example two layer flow structure of FIG. 3A includes a production fluid 310 and a nonproduction fluid 316 at an angle of 91°.

As shown in FIG. 3A with the wellbore inclined at 89-degrees, the oil, which is lighter than the water, accelerates under the action of the buoyancy forces. As a consequence the water velocity decreases (see the nonproduction fluid 312) and the interface level rises between the nonproduction fluid 312 and the production fluid 306. In this case, the water holdup is high. The effect is large, even at 89°, because the longitudinal buoyancy forces are already large compared to the frictional shearing forces. Here the water is flowing uphill, and therefore flows more slowly than the lighter oil. In some implementations, the leveling system (as described herein) may be adjusted to cause the phenomena described above (or prevent related phenomena). Alternatively or in addition, the flow dividers may be controlled to create the phenomena too (or prevent related phenomena). Alternatively or in addition, the leveler and/or the flow dividers may be used (or controlled) to reduce or prevent these phenomena.

Also, as shown in FIG. 3A with the wellbore inclined at 91-degrees, the water flows downhill much faster (see the nonproduction fluid 316) than the oil (see the production fluid 310) because its density is higher. The oil-water interface level drops, and the water holdup is low. At high flow rates, the dependence on borehole deviation is smaller because the increasing shear frictional forces against the wall and interface dominate. Under high flow-rate conditions, the position of the interface, and therefore average water holdup, is not as dependent on borehole deviation as is the case in lower rates of flow.

FIG. 3B includes a pictorial graph 350 having a horizontal axis 352 that is a deviation from vertical and a vertical axis 354 that is the total flow rate. FIG. 3B depicts three example two-layer flow structures for a total flow rate of 1500 B/D. A first example two-layer flow structure of FIG. 3B includes a production fluid 356 and a nonproduction fluid 362 at an angle of 89°. A second example two-layer flow structure of FIG. 3B includes a production fluid 358 and a nonproduction fluid 364 at an angle of 90°. A third example two-layer flow structure of FIG. 3B includes a production fluid 360 and a nonproduction fluid 366 at an angle of 91°.

FIG. 3C includes a pictorial graph 370 having a horizontal axis 372 that is a deviation from vertical and a vertical axis 374 that is the total flow rate. FIG. 3C depicts three example two-layer flow structures for a total flow rate of 6000 B/D. A first example two-layer flow structure of FIG. 3C includes a production fluid 376 and a nonproduction fluid 382 at an angle of 89°. A second example two-layer flow structure of FIG. 3C includes a production fluid 378 and a nonproduction fluid 384 at an angle of 90°. A third example two-layer flow structure of FIG. 3C includes a production fluid 380 and a nonproduction fluid 386 at an angle of 91°.

Example implementations may address the problem of efficiently separating the water from the oil downhole. By taking advantage of the two-layer flow structure, most of the separation process may be handled by taking advantage of the naturally occurring two-layer flow structure shown in FIGS. 3A-3C.

Figure 4A:
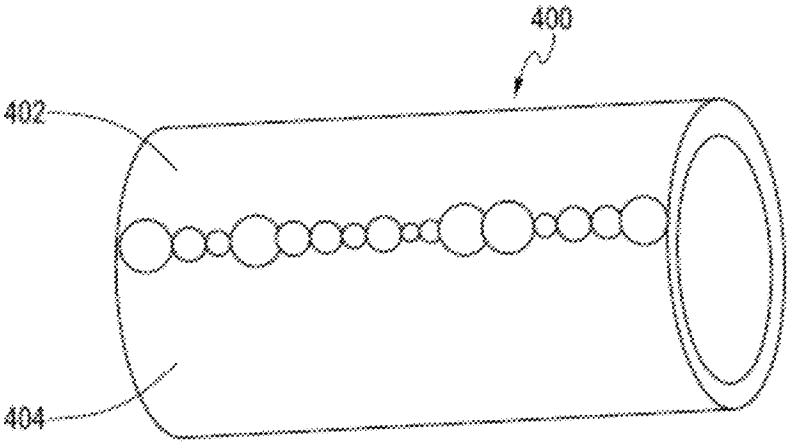
FIG. 4A is a pictorial view that shows that in horizontal wells, the flow becomes stratified with a production fluid layer on top and a non-production fluid layer on bottom, according to some embodiments.

To further illustrate, FIG. 4A is a pictorial view that shows that in horizontal wells, the flow becomes stratified with a production fluid layer on top and a non-production fluid layer on bottom, according to some embodiments. FIG. 4A depicts a portion of a horizontal well 400 that includes a stratified flow that includes a production fluid 402 on top and a nonproduction fluid 404 on bottom. Such a horizontal well allows for almost stratified flows, wherein there is a narrow mixing layer between the two fluids.

Figure 4B:
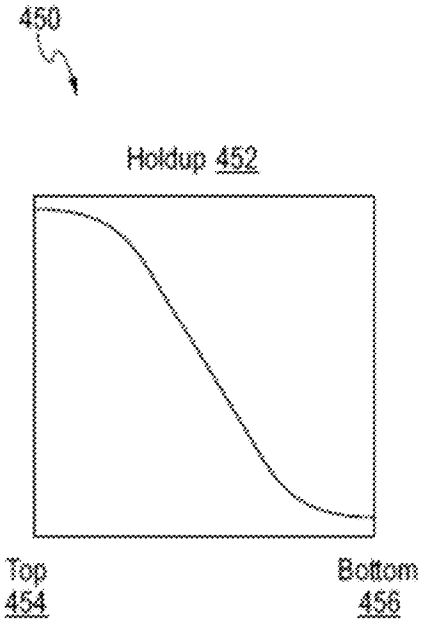
FIG. 4B is a graph of a velocity of the production fluid and the nonproduction fluid, according to some embodiments.

FIG. 4B is a graph of a velocity of the production fluid and the nonproduction fluid, according to some embodiments. FIG. 4B depicts a graph 450 having that illustrates a velocity 452 relative to a top 454 and a bottom 456 of the two-flow structure (the production fluid and the nonproduction fluid, respectively). As shown, the two fluids flow at different velocities.

Figure 4C:
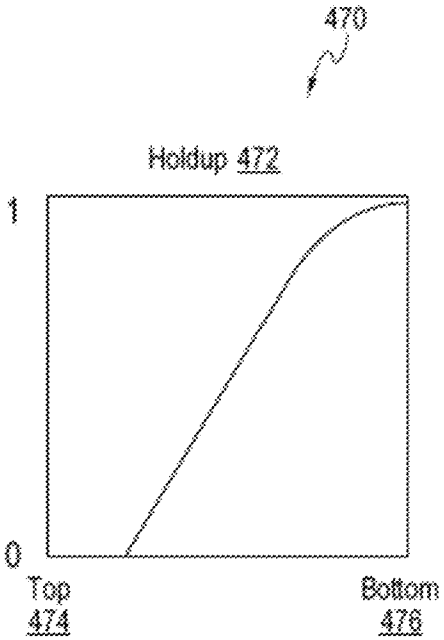
FIG. 4C is a graph of a holdup of the production fluid and the nonproduction fluid, according to some embodiments.

Conversely, FIG. 4C is a graph of a holdup of the production fluid and the nonproduction fluid, according to some embodiments. FIG. 4C depicts a graph 470 having that illustrates a holdup 472 relative to a top 474 and a bottom 476 of the two-flow structure (the production fluid and the nonproduction fluid, respectively). As shown, the two fluids flow at different holdups.

Example implementations may divide and separate the two layers downhole and then perform any additional separation processes uphole. One or more diverters may be used in a well. The diverters may be closely spaced such as within a few millimeters of one another. The diverters may be spaced a few centimeters apart, a few meters, and/or a few kilometers apart. Other devices, such as those disclosed herein, may also be spaced accordingly. Other devices to support the functionality of the diverters may be placed anywhere in the well, at the sea floor, at the surface, in the "cloud", at one or more remote sites, etc.

The one or more diverters (and supporting devices) may be used in a subsea process. The subsea process may be within the well, in the Christmas tree, in a flow control device, in pumping device, in a storage device, in another pumping device or system (such as a discharge system from processing equipment, storage equipment, etc.), etc.

The one or more diverters, flow separator systems, systems that employee one or more diverters, DOWS system or component, DOWSS system or component may include systems for decision-making, monitoring, control of process (es) can be a combination: human, computer, controller, software, logical hardware and/or software, on-rig, remotely, in the cloud, on the edge, downhole, Artificial Intelligence (AI)-related, Deep Learning, Neural Network, Machine Learning, software, hardware, Fuzzy Logic, etc. The components, software, hardware, etc. may be partially located downhole (i.e. smart machines), partially located at the surface, partially located at the sea floor, partially located within the cloud, partially located on the edge, partially located at a remote facility.

In horizontal wells, with deviation from approximately 85° to 95°, the flow structure may become completely stratified, with little or no mixing. Water flows at the bottom, and the oil or gas phase flows at the top. Example implementations may include installation of a flow divider into the flow stream of formation fluid in a horizontal well. The flow divider may rise and fall as the height of the flow streams change.

After the fluids pass the flow divider, the lighter oil stream may be passed through processing equipment to remove more water and solids. Then the production fluid may be pumped to surface. The production fluid may also be pumped to the subsea floor for further processing, transportation and/or storage. The heavier (denser) water stream may pass under the flow divider and into another channel where it may be processed to remove oil and solids.

As important as emulsion stability is in many industrial processes and products, breaking up the emulsion may be important. Some implementations may include demulsification. Demulsification, or emulsion breaking, may be important in hydrocarbon recovery, waste water treatment, etc. In hydrocarbon recovery, water-in-oil emulsions are typically produced. These emulsions can be extremely stable due to the asphaltenes and resins naturally found in many crude oils. The effective separation of crude oil and water is crucial in terms of crude oil quality but also to ensure the high quality of the separated water phase at the lowest possible cost. Demulsifiers may be used to destabilize water-in-oil emulsions. From the process point of view, there may be two aspects of demulsifications: the rate at which the separation takes place and the amount of water left in the crude oil. Produced oil often has to meet the company and pipeline specifications.

Typically, the oil shipped from a wet crude-handling facility may not contain more than 0.2% BS &W (basic sediment and water) or 4.5 kg of salt per thousand barrels of crude oil. This rather low concentration requirement is to reduce corrosion and the deposition of salts.

Emulsion separation into oil and water involves the destabilization of the emulsifying film around water droplets. There may be several methods that may be used to destabilize the emulsion. Such methods may include the addition of chemical demulsifiers, increasing the temperature of the emulsion, applying electrical fields that promote coalescence and changing the physical characteristics of the emulsion. The addition of chemical demulsifiers is by far the most commonly used method.

Demulsifiers are surface active agents that are designed to migrate at the oil-water interface and neutralize the effect of emulsifying agents. The selection of the right demulsifier may be crucial in the emulsion-breaking process. Because of the large variety of components present in crude oil, it is important to select the demulsifier based on the crude oil type. Interfacial rheology parameters, especially the interfacial dilatation elasticity, are known to correlate with emulsion stability. The effectiveness of the demulsifiers is thus studied by measuring the interfacial rheology of the oil-water interface in the presence of added demulsifiers.

Then the processed water may be disposed off into a multilateral wellbore, a wellbore below the production zone, a wellbore or thief zone above the production zone or may be pumped to the subsea floor or surface for further processing, transportation and/or storage.

In some implementations, the flow diverter may be actuated by hydraulic cylinders or electrical actuators. The ESP power cable can provide the power to these hydraulic cylinders or electrical actuators. The flow diverter may be made of a buoyant material. The flow diverter may be filled with a liquid of the desired density similar to a heater-treater float valve. The flow diverter may have counterweights that can be adjusted remotely.

Example diverters are now illustrated with reference to FIGS. 5-11. For example, with reference to FIG. 2, the example diverters of FIGS. 5-11 may represent or be part of the fluid separator 296 and the separator 201.

Figure 5:
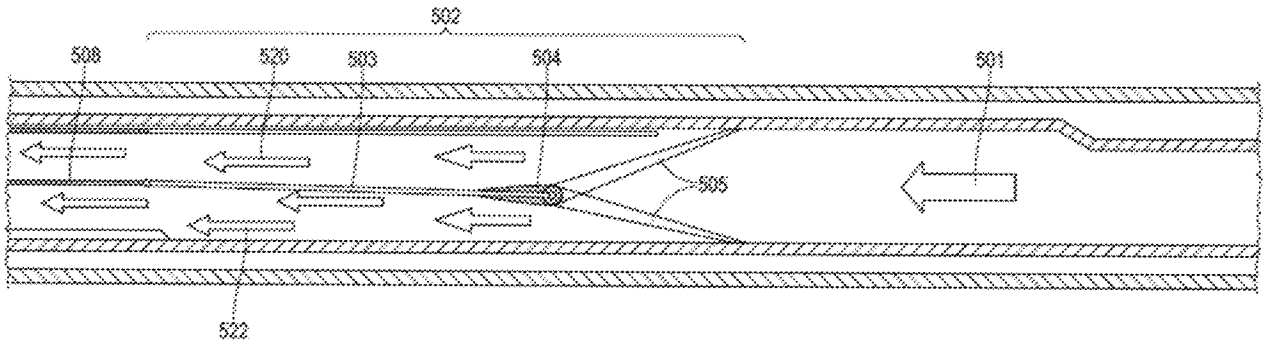
FIG. 5 is a cross sectional side view of an example flow diverter that floats or rides at the interface of the two flow streams which channels the flows into two different flow channels, according to some embodiments.

FIG. 5 is a cross sectional side view of an example flow diverter that floats or rides at the interface of the two flow streams which channels the flows into two different flow channels, according to some embodiments. As described above, the formation fluid may naturally separate into 2 or more immiscible flow streams. Immiscible (with regard to two or more liquids) may be liquids incapable of being mixed to form a homogeneous substance. An example of two such fluids may be oil and water.

FIG. 5 depicts a diverter 502 that may include a hinge 506, a diverter arm 503, a float 504, and a diverter fin 505. The hinge 506 may be coupled to the diverter arm 503 that is coupled to the float 504 that is coupled to the diverter fin 505. In this example, the diverter fin 505 is shown in two positions (an upper position and a lower position). In some implementations, the diverter fin 505 may be a buoyant material. However, the diverter fin 505 may also be located at any position between the upper and lower positions (depending on the buoyancy of the flow). The hinge 506 may be articulated by a change in a density or buoyancy of the formation fluid 501, the production fluid 520, and/or the nonproduction fluid 522. The hinge 506 and/or the diverter fin 505 may also be articulated in partial by other components or parameters (such as fluid velocity, one or more sensed parameters, manual override, inclination of wellbore, casing/tubular, or the diverter 502 itself. etc. In some implementations, the diverter 502 and/or one or more of its components may be controlled/changed azimuthally (rotated about the longitudinal axis of the wellbore). The hinge 506 may also be coupled to a separator (or wall) 508.

As shown, a formation fluid 501 flows from downhole toward the diverter 502. The formation fluid 501 may include a production fluid 520 and a nonproduction fluid 522. As described above, the production fluid 520 and the nonproduction fluid 522 may separate into two flows such that the production fluid 520 is above the nonproduction fluid 522. The diverter 502 may move into a position between the production fluid 520 and the nonproduction fluid 522.

In some implementations, the float 504 and/or the diverter fin 505 may be filled with the production fluid 520 and/or with a fluid have a density that is substantially the same as a density of the production fluid 520. This will allow the float 504 and/or the diverter fin 505 to float on top of the nonproduction fluid 522. Accordingly, as more nonproduction fluid 522 is in the flow, the float 504 and/or the diverter fin 505 will float up in the flow. Conversely, as less nonproduction fluid 522 is in the flow, the float 504 and/or the diverter fin 505 will float down in the flow. Thus, the buoyancy of one or more of the components of the diverter 502 adjusts such that more of the production fluid 520 is above the diverter 502 than below the diverter and such that more of the nonproduction fluid 522 is below the diverter 502 than above the diverter 502.

In some implementations, the density of the fluid that fills the float 504 and/or the diverter fin 505 is substantially the same as a density of the production fluid 520 if the density of the fluid that fills the float 504 and/or the diverter fin 505 is within a 5% difference of the density of the production fluid 520. In some implementations, the density of the fluid that fills the float 504 and/or the diverter fin 505 is substantially the same as a density of the production fluid 520 if the density of the fluid that fills the float 504 and/or the diverter fin 505 is within a 1% difference of the density of the production fluid 520. In some implementations, the density of the fluid that fills the float 504 and/or the diverter fin 505 is substantially the same as a density of the production fluid 520 if the density of the fluid that fills the float 504 and/or the diverter fin 505 is within a 2% difference of the density of the production fluid 520. In some implementations, the density of the fluid that fills the float 504 and/or the diverter fin 505 is substantially the same as a density of the production fluid 520 if the density of the fluid that fills the float 504 and/or the diverter fin 505 is within a 3% difference of the density of the production fluid 520. In some implementations, the density of the fluid that fills the float 504 and/or the diverter fin 505 is substantially the same as a density of the production fluid 520 if the density of the fluid that fills the float 504 and/or the diverter fin 505 is within a 4% difference of the density of the production fluid 520. In some implementations, the density of the fluid that fills the float 504 and/or the diverter fin 505 is substantially the same as a density of the production fluid 520 if the density of the fluid that fills the float 504 and/or the diverter fin 505 is within a 10% difference of the density of the production fluid 520. In some implementations, the density of the fluid that fills the float 504 and/or the diverter fin 505 is substantially the same as a density of the production fluid 520 if the density of the fluid that fills the float 504 and/or the diverter fin 505 is within a 25% difference of the density of the production fluid 520.

Alternatively or in addition to having a fluid in the float 504 and/or the diverter fin 505, a controller, for example controller 270 shown in FIG. 2, may be used to control the movement of the diverter 502 within the flow of the formation fluid 501 so that the production fluid 520 and the nonproduction fluid 522 are above and below, respectively. For example, one or more sensors may be positioned at different locations relative to the flows. Such sensors may sense density, viscosity, etc. that may be used to determine how to control a position of the diverter 502 a controller such as controller 270.

In some implementations, at least one sensor may be downstream of the diverter 502. For instance, a sensor could be positioned downstream of the diverter 502 in the flow of the production fluid 520 and/or a sensor could be positioned downstream of the diverter 502 in the flow of the nonproduction fluid 522. Such sensors could be downhole and/or at the surface of the well. In some implementations, at least one sensor may be upstream of the diverter 502.

Figure 6:
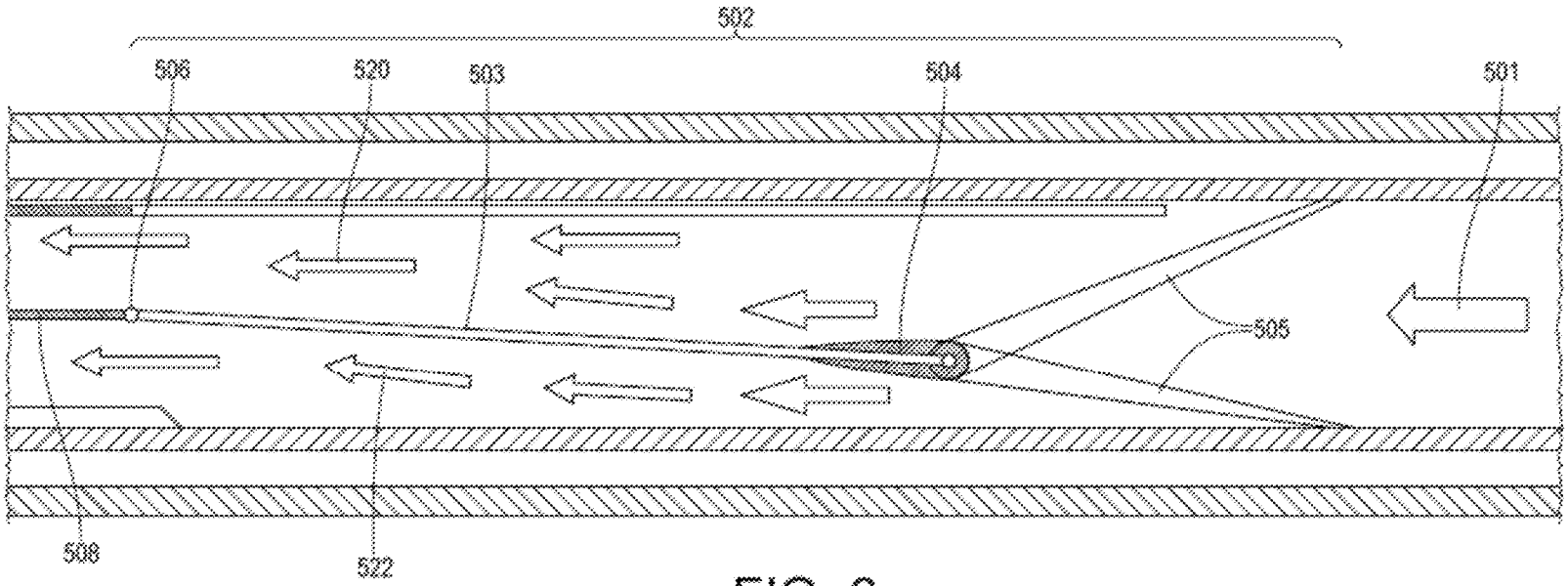
FIG. 6 is a cross sectional side view of the example flow diverter of FIG. 5 that lowers in response to the production fluid percentage increasing (as compared to the nonproduction fluid), according to some embodiments.

FIG. 6 is a cross sectional side view of the example flow diverter of FIG. 5 that lowers in response to the production fluid percentage increasing (as compared to the nonproduction fluid), according to some embodiments. This may be due to the density of the two fluids (production and nonproduction fluids). FIG. 6 depicts the diverter 502 that may include the hinge 506, the diverter arm 503, the float 504, and the diverter fin 505. The hinge 506 may be coupled to the diverter arm 503 that is coupled to the float 504 that is coupled to the diverter fin 505. In this example, the diverter fin 505 is shown in two positions (an upper position and a lower position). However, the diverter fin 505 may also be located at any position between the upper and lower positions (depending on the buoyancy of the flow of the one or more fluids). The hinge 506 may be articulated by a change in a density or buoyancy of the formation fluid 501, the production fluid 520, and/or the nonproduction fluid 522. The hinge 506 is also coupled to a separator (or wall) 508. In the example of FIG. 6, the component(s) of the diverter 502 lowers because the percentage of the production fluid 520 has increased.

Figure 7:
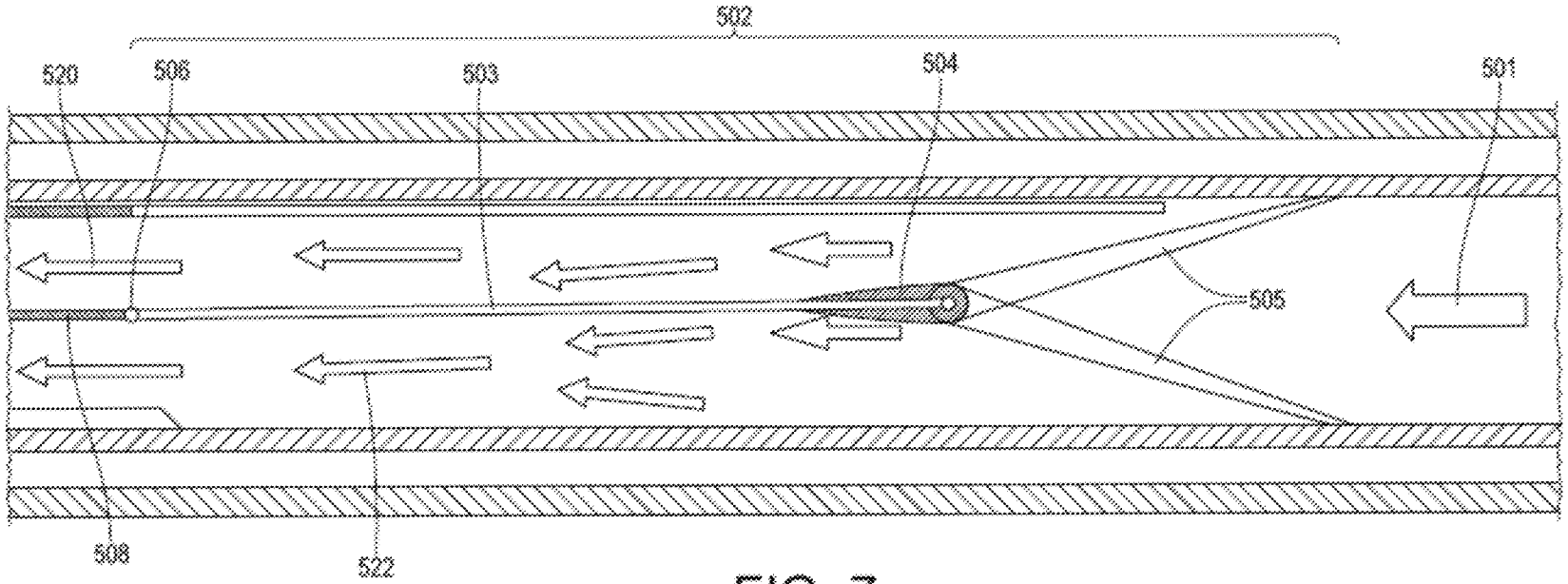
FIG. 7 is a cross sectional side view of an example flow diverter of FIG. 5 that rises in response to the nonproduction fluid percentage increasing (as compared to the production fluid), according to some embodiments.

FIG. 7 is a cross sectional side view of an example flow diverter of FIG. 5 that rises in response to the nonproduction fluid percentage increasing (as compared to the production fluid), according to some embodiments. FIG. 7 depicts the diverter 502 that may include the hinge 506, the diverter arm 503, the float 504, and the diverter fin 505. The hinge 506 may be coupled to the diverter arm 503 that is coupled to the float 504 that is coupled to the diverter fin 505. In this example, the diverter fin 505 is shown in two positions (an upper position and a lower position). However, the diverter fin 505 may also be located at any position between the upper and lower positions (depending on the buoyancy of the flow of the fluids). The hinge 506 may be articulated by a change in a density or buoyancy of the formation fluid 501, the production fluid 520, and/or the nonproduction fluid 522. The hinge 506 is also coupled to a separator (or wall) 508. In the example of FIG. 7, the diverter 502 rises because the percentage of the nonproduction fluid 522 has increased.

Figure 8:
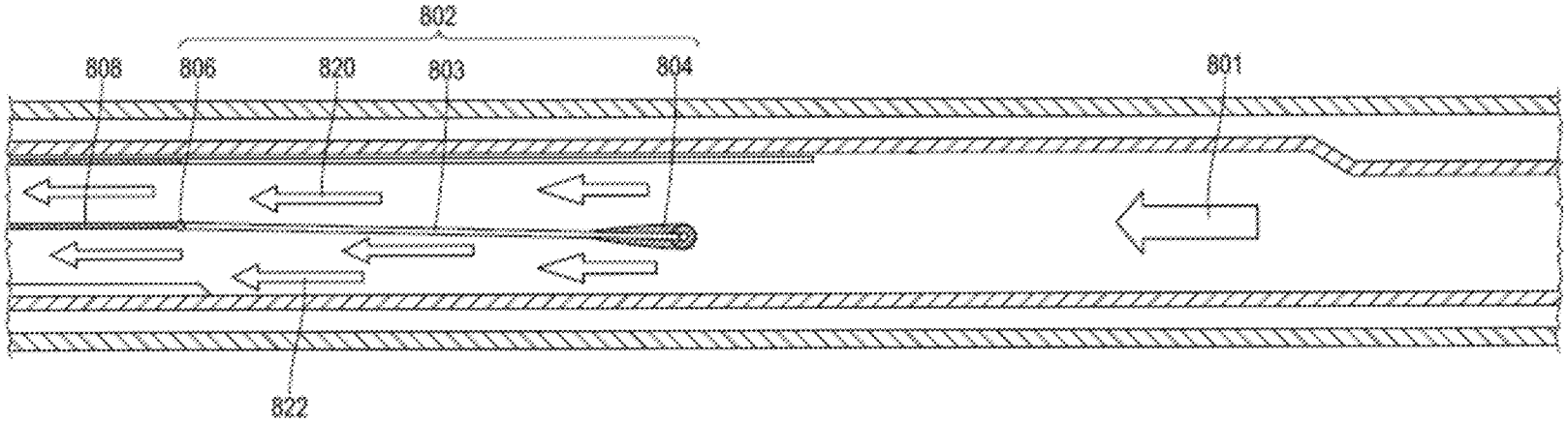
FIG. 8 is a cross sectional side view of another example flow diverter that floats or rides at the interface of the two flow streams which channels the flows into two different flow channels, according to some embodiments.

FIG. 8 is a cross sectional side view of another example flow diverter that floats or rides at the interface of the two flow streams which channels the flows into two different flow channels, according to some embodiments. In contrast to the example of FIGS. 5-7, the example flow diverter of FIG. 8 does not include a diverter fin.

FIG. 8 depicts a diverter 802 that may include a hinge 806, a diverter arm 803, and a float 804. The hinge 806 may be coupled to the diverter arm 803 that is coupled to the float 804. The hinge 806 may be articulated by a change in a density or buoyancy of a formation fluid 801, a production fluid 820, and/or a nonproduction fluid 822. The hinge 806 is also coupled to a separator (or wall) 808.

The shape of the float 804, the diverter arm 803, the hinge 806, the separator 808, and the diverter 802 may vary according the specific needs of a well, DOWS, DOWSS, etc. For example, the shape of the float 804 may be a mirror image of what is shown—with the opposite end facing the flow of the formation fluid 801. The shape of the float 804 may enhance the flow profile of the formation fluid 801, the production fluid 820 and/or the nonproduction fluid 822. For example, the shape of the float 804 may entice the one or more flow profiles to maintain a laminar flow or decrease the turbulence in one or more of the flows.

As shown, the formation fluid 801 flows from downhole toward the diverter 802. The formation fluid 801 may include a production fluid 820 and a nonproduction fluid 822. As described above, the production fluid 820 and the nonproduction fluid 822 may separate into two flows such that the production fluid 820 is above the nonproduction fluid 822. The diverter 502 may move into a position between the production fluid 820 and the nonproduction fluid 822.

In some implementations, the float 804 may be filled with the production fluid 820 and/or with a fluid having a density that is substantially the same as a density of the production fluid 820. This will allow the float 804 to float on top of the nonproduction fluid 822. Accordingly, as more nonproduction fluid 822 is in the flow, the float 804 will float up in the flow. Conversely, as less nonproduction fluid 822 is in the flow, the float 804 will float down in the flow. Thus, the buoyancy of the diverter 802 adjusts such that more of the production fluid 820 is above the diverter 802 than below the diverter and such that more of the nonproduction fluid 822 is below the diverter 802 than above the diverter 802.

In some implementations, the density of the fluid that fills the float 804 is substantially the same as a density of the production fluid 820 if the density of the fluid that fills the float 804 is within a 5% difference of the density of the production fluid 820. In some implementations, the density of the fluid that fills the float 804 is substantially the same as a density of the production fluid 820 if the density of the fluid that fills the float 804 is within a 1% difference of the density of the production fluid 820. In some implementations, the density of the fluid that fills the float 804 is substantially the same as a density of the production fluid 820 if the density of the fluid that fills the float 804 is within a 2% difference of the density of the production fluid 820. In some implementations, the density of the fluid that fills the float 804 is substantially the same as a density of the production fluid 820 if the density of the fluid that fills the float 804 is within a 3% difference of the density of the production fluid 820. In some implementations, the density of the fluid that fills the float 804 is substantially the same as a density of the production fluid 820 if the density of the fluid that fills the float 804 is within a 4% difference of the density of the production fluid 820. In some implementations, the density of the fluid that fills the float 804 is substantially the same as a density of the production fluid 820 if the density of the fluid that fills the float 804 is within a 10% difference of the density of the production fluid 820. In some implementations, the density of the fluid that fills the float 804 is substantially the same as a density of the production fluid 820 if the density of the fluid that fills the float 804 is within a 25% difference of the density of the production fluid 820. In some implementations, the shape of the diverter arm 803 and the float 804 may have different shapes, lengths, configurations, etc. to ensure they will function properly.

Alternatively or in addition to having a fluid in the float 804, a controller may be used to control the movement of the diverter 802 within the flow of the formation fluid 801 so that the production fluid 820 and the nonproduction fluid 822 are above and below, respectively. For example, one or more sensors may be positioned at different locations relative to the flows. Such sensors may sense density, viscosity, etc. that may be used to determine how to control a position of the diverter 802. The controller and sensors may be advantageous in wells at a deviation. In a deviated well, the mixing layer thickness may be later and having only a buoyant float may not be enough.

In some implementations, at least one sensor may be downstream of the diverter 802. For instance, a sensor could be positioned downstream of the diverter 802 in the flow of the production fluid 820 and/or a sensor could be positioned downstream of the diverter 802 in the flow of the nonproduction fluid 822. Such sensors could be downhole and/or at the surface of the well. In some implementations, at least one sensor may be upstream of the diverter 802.

In some implementations of flow diverters shown in FIGS. 5-8, at least one sensor may interface with controller 270 of FIG. 2 to provide information regarding the production fluid 520-820, nonproduction fluid 522-822, the formation fluid 5601-801, the quantity of oil, water, liquids, gases, or combinations thereof. One or more sensor may provide information about the position, health, condition, stresses, vibrations of one or more components of diverters 502, 602, 702, and/or 802 and/or associated DOW system(s) and components.

In some implementations, computer 270 is communicatively coupled to system 100, separation system 124, separation system 200, diverters 502, 602, 702, and/or 802 and/or one or more components of the systems 100, 124, 200, 502, 602, 702, and/or 802, etc.

For one example, computer 270 may control one or more parameters of diverter 802 in order to increase the life of the system 100. In other words, the diverter 802, its components, separation system 124, its components, and system 100 will operate longer and more efficiently by specifically having the computer 270 monitoring, controlling, diagnosing, and maintaining diverter 802.

Continuing with this example of diverter 802, computer 270 may address one or more specific conditions or problems with diverter 802. For example, computer 270 may monitor the position of diverter 802. If the float position is too high compared to the volume of production fluid 820 that is being produced at the surface, then computer 270 may send a signal to separation system 124 to reduce the speed of one or more pumps. Computer 270 will continue to monitor the position of the float of diverter 802.

In this example, if the divertor 802 float is still too high, the computer 270 can perform one or more of the following within a short amount of time (e.g., microseconds, milliseconds, seconds, etc.):

a. Backflush system 124 to clear trapped debris or eliminate a gas lock, etc.
b. Analyze system 124 and one or more of its components via computer 270's on-chip/on-board processor and/or algorithm,
c. Perform other actions, analysis, function(s) to aid in returning the system 124 to a better state (e.g., divertor 802 float functioning properly, increased operating efficiency, increased processed sediments/solids, etc.)

The above example also exemplifies how computer 270 may increase the efficiency of systems 800, 124, and/or 100 and their respective components. As noted, computer 270 may monitor, adjust, optimize the systems and components to achieve one or more goals (e.g., maximize fluid production, reduce operating costs, increase life, etc.).

In addition, the above example exemplifies how computer 270 may increase the life of system 100, separation system 124, system 802, and/or one or more components of the systems 100, 124, 200. In other words, computer 270 is able to monitor, control, diagnose, maintain and repair, etc., said systems and component to prevent premature failure.

The computer/controller 270 may comprise devices, hardware, software, etc. including but not limited to: switches, power supplies, connectors, transmission lines, logic devices, software, hardware, artificial intelligence, machine learning, algorithms, and other devices known and not known in the current realm of controls, computers, material processing, energy industry, etc. FIGS. 13-16 provide examples of other processes and components that may be monitored, controlled and optimized by sensors and computer/controller 270.

Figure 9:
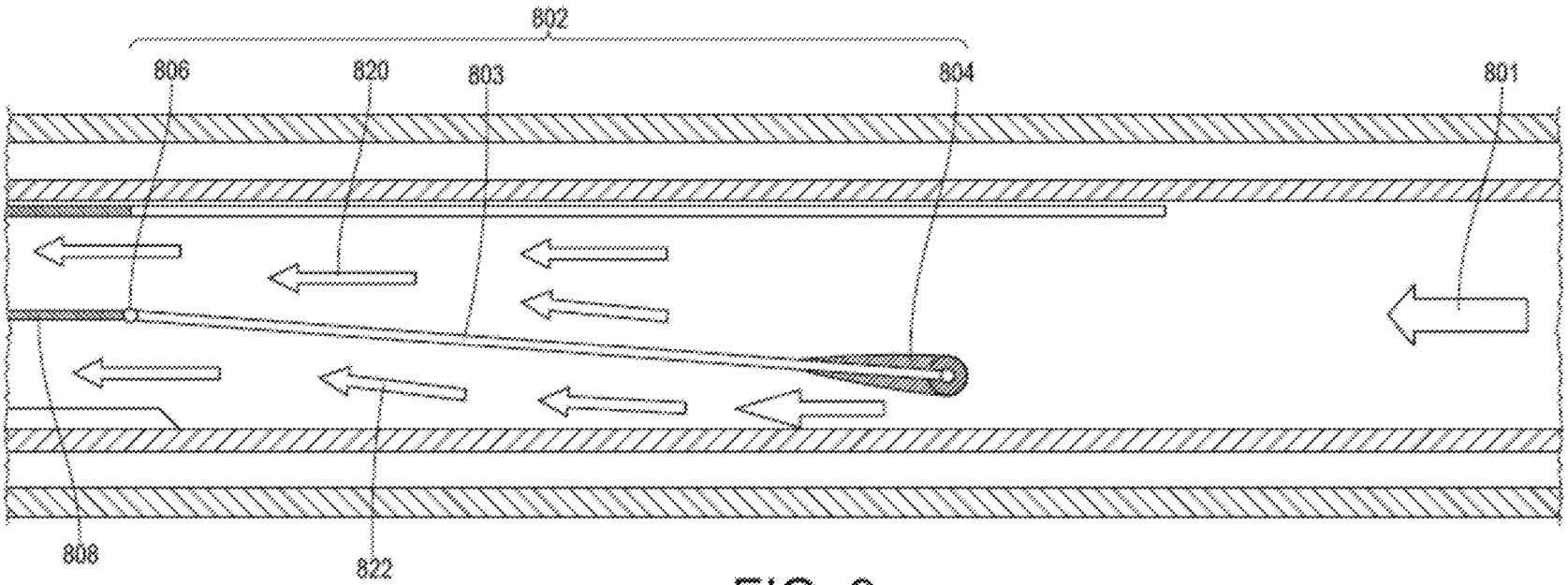
FIG. 9 is a cross sectional side view of the example flow diverter of FIG. 8 that lowers in response to the production fluid percentage increasing (as compared to the nonproduction fluid), according to some embodiments.

FIG. 9 is a cross sectional side view of the example flow diverter of FIG. 8 that lowers in response to the production fluid percentage increasing (as compared to the nonproduction fluid), according to some embodiments. FIG. 9 depicts the diverter 802 that may include the hinge 806, the diverter arm 803, and the float 804. The hinge 806 may be coupled to the diverter arm 803 that is coupled to the float 804. The hinge 806 may be articulated by a change in a density or buoyancy of the formation fluid 801, the production fluid 820, and/or the nonproduction fluid 822. The hinge 806 is also coupled to a separator (or wall) 808. In the example of FIG. 9, the diverter 802 lowers because the percentage of the production fluid 820 has increased.

Figure 10:
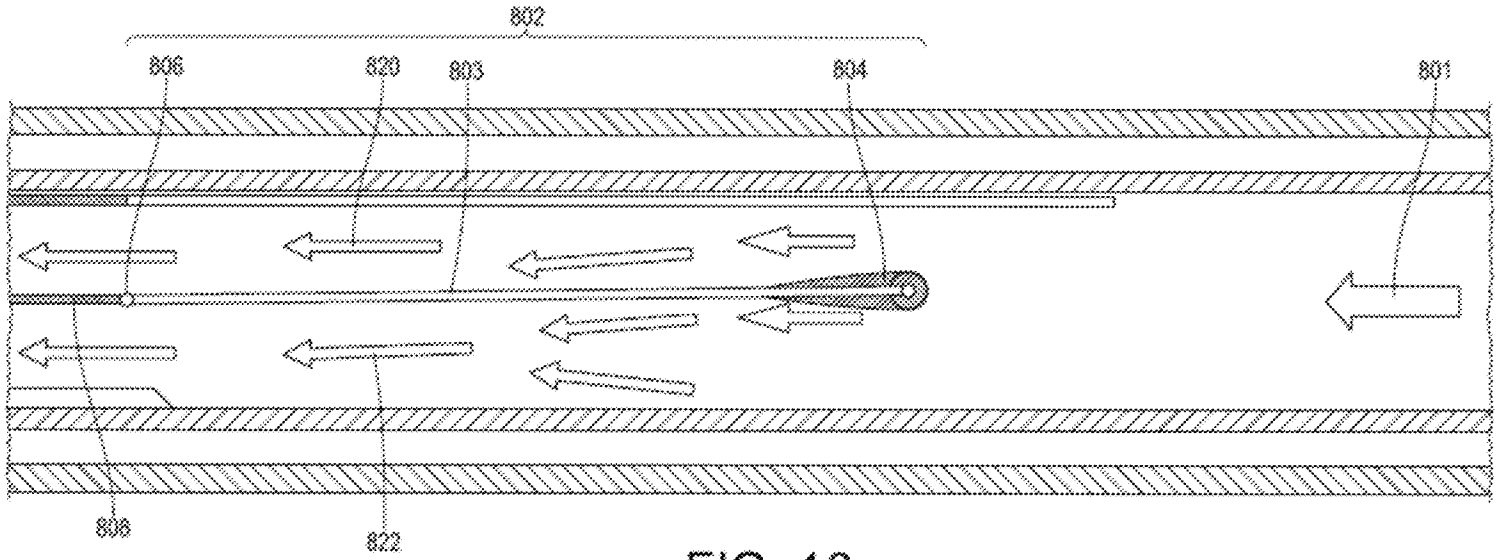
FIG. 10 is a cross sectional side view of an example flow diverter of FIG. 8 that rises in response to the nonproduction fluid percentage increasing (as compared to the production fluid), according to some embodiments.

FIG. 10 is a cross sectional side view of an example flow diverter of FIG. 8 that rises in response to the nonproduction fluid percentage increasing (as compared to the production fluid), according to some embodiments. FIG. 10 depicts the diverter 802 that may include the hinge 806, the diverter arm 803, and the float 804. The hinge 806 may be coupled to the diverter arm 803 that is coupled to the float 804. The hinge 806 may be articulated by a change in a density or buoyancy of the formation fluid 801, the production fluid 820, and/or the nonproduction fluid 822. The hinge 806 is also coupled to a separator (or wall) 808. In the example of FIG. 10, the diverter 802 rises because the percentage of the nonproduction fluid 822 has increased.

Figure 11:
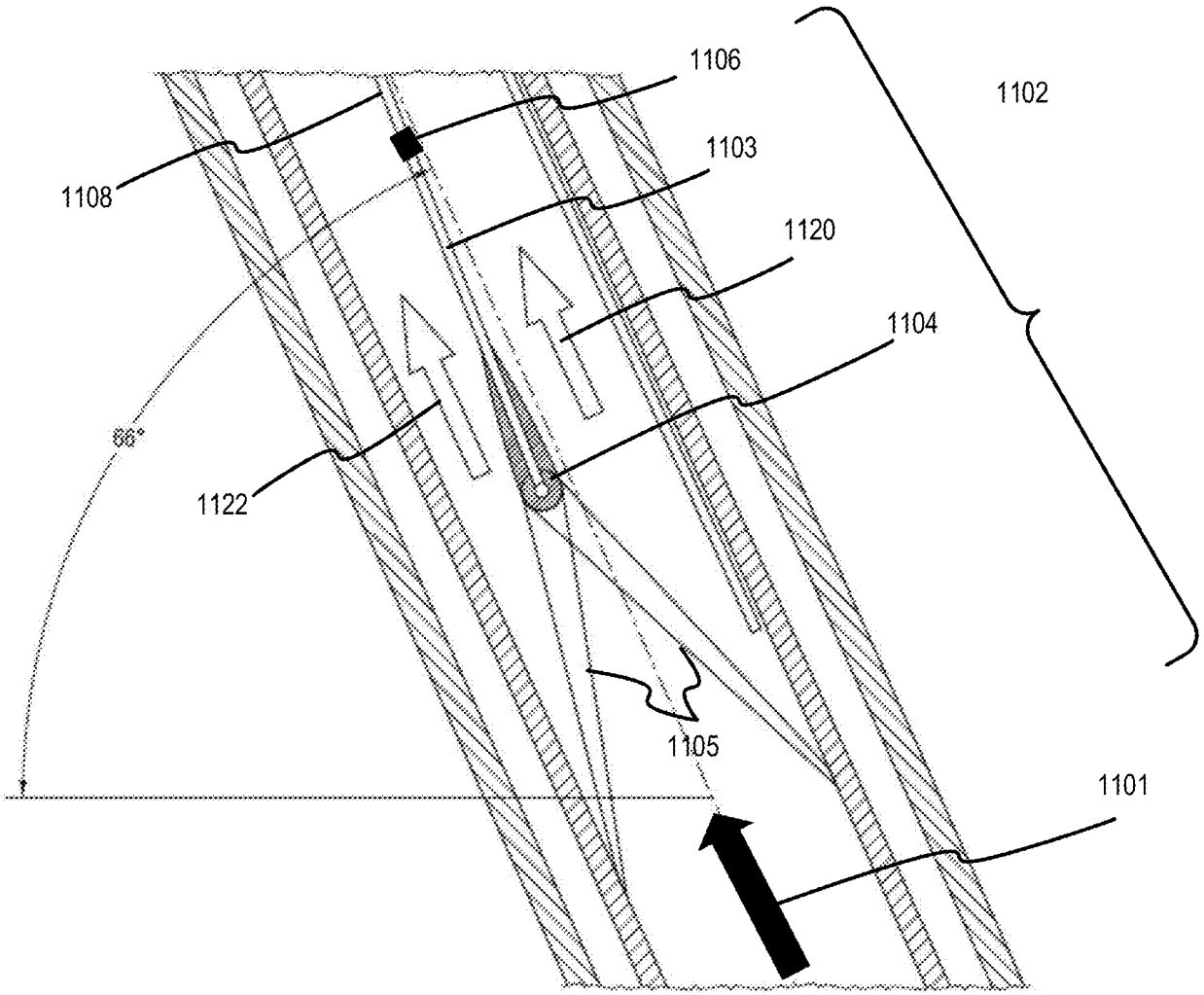
FIG. 11 is a cross-sectional side view of an example flow diverter that is positioned in an inclined portion of a well and that floats or rides at the interface of the two flow streams which channels the flows into two different flow channels, according to some embodiments.

While depicted such that the diverter is positioned in a horizontal portion of a well, example implementations may also incorporate the diverter into non-horizontal portions of a well. To illustrate, FIG. 11 is a cross-sectional side view of an example flow diverter that is positioned in an inclined portion of a well and that floats or rides at the interface of the two flow streams which channels the flows into two different flow channels, according to some embodiments. In this example, this section of the well that includes the diverter is approximately 66 degrees from horizontal. Example implementations may incorporate the diverter into sections of the well at any other degree from horizontal. Also, FIG. 11 depicts a diverter that includes a diverter fin. Example implementations may include a diverter without a diverter fin.

FIG. 11 depicts a diverter 1102 that may include a hinge 1106, a diverter arm 1103, a float 1104, and a diverter fin 1105. The hinge 1106 may be coupled to the diverter arm 1103 that is coupled to the float 1104 that is coupled to the diverter fin 1105. In this example, the diverter fin 1105 is shown in two positions (an upper position and a lower position). However, the diverter fin 1105 may also be located at any position between the upper and lower positions (depending on the buoyancy of the flow). The hinge 1106 may be articulated by a change in a density or buoyancy of the formation fluid 1101, the production fluid 1120, and/or the nonproduction fluid 1122. The hinge 1106 is also coupled to a separator (or wall) 1108.

As shown, a formation fluid 1101 flows from downhole toward the diverter 1102. The formation fluid 1101 may include a production fluid 1120 and a nonproduction fluid 1122. As described above, the production fluid 1120 and the nonproduction fluid 1122 may separate into two flows such that the production fluid 1120 is above the nonproduction fluid 1122. The diverter 1102 may move into a position between the production fluid 1120 and the nonproduction fluid 1122.

In some implementations, the float 1104 and/or the diverter fin 1105 may be filled with the production fluid 1120 and/or with a fluid have a density that is substantially the same as a density of the production fluid 1120. This will allow the float 1104 and/or the diverter fin 1105 to float on top of the nonproduction fluid 1122. Accordingly, as more nonproduction fluid 1122 is in the flow, the float 1104 and/or the diverter fin 1105 will float up in the flow. Conversely, as less nonproduction fluid 1122 is in the flow, the float 1104 and/or the diverter fin 1105 will float down in the flow. Thus, the buoyancy of the diverter 1102 adjusts such that more of the production fluid 1120 is above the diverter 1102 than below the diverter and such that more of the nonproduction fluid 1122 is below the diverter 1102 than above the diverter 1102.

In some implementations, the density of the fluid that fills the float 1104 and/or the diverter fin 1105 is substantially the same as a density of the production fluid 1120 if the density of the fluid that fills the float 1104 and/or the diverter fin 1105 is within a 5% difference of the density of the production fluid 1120. In some implementations, the density of the fluid that fills the float 1104 and/or the diverter fin 1105 is substantially the same as a density of the production fluid 1120 if the density of the fluid that fills the float 1104 and/or the diverter fin 1105 is within a 1% difference of the density of the production fluid 1120. In some implementations, the density of the fluid that fills the float 1104 and/or the diverter fin 1105 is substantially the same as a density of the production fluid 1120 if the density of the fluid that fills the float 1104 and/or the diverter fin 1105 is within a 2% difference of the density of the production fluid 1120. In some implementations, the density of the fluid that fills the float 1104 and/or the diverter fin 1105 is substantially the same as a density of the production fluid 1120 if the density of the fluid that fills the float 1104 and/or the diverter fin 1105 is within a 3% difference of the density of the production fluid 1120. In some implementations, the density of the fluid that fills the float 1104 and/or the diverter fin 1105 is substantially the same as a density of the production fluid 1120 if the density of the fluid that fills the float 1104 and/or the diverter fin 1105 is within a 4% difference of the density of the production fluid 1120. In some implementations, the density of the fluid that fills the float 1104 and/or the diverter fin 1105 is substantially the same as a density of the production fluid 1120 if the density of the fluid that fills the float 1104 and/or the diverter fin 1105 is within a 10% difference of the density of the production fluid 1120.

In deviated wellbores, the formation fluid 1101 may comprise a multiphase flow that comprises a mixing layer of bubbles, emulsion, or combination thereof. The mixing layer may be considerable. Accordingly, a float 1104 and/or diverter fin 1105 may need to be filled with different fluids. For example, diverter fin 1105 may filled with a fluid with a buoyancy similar to the buoyance of oil. The float 1104 may be filled with a fluid with a buoyancy somewhere between 100% oil and 100% water. The shape and geometry of the float 1104 and the diverter fin 1105 may be optimized to operate better when in a deviated well or well where the mixing layer is substantial (e.g., 10%-75% of the total fluids).

Alternatively or in addition to having a fluid in the float 1104 and/or the diverter fin 1105, a controller may be used to control the movement of the diverter 1102 within the flow of the formation fluid 1101 so that the production fluid 1120 and the nonproduction fluid 1122 are above and below, respectively. For example, one or more sensors may be positioned at different locations relative to the flows. Such sensors may sense density, viscosity, etc. that may be used to determine how to control a position of the diverter 1102.

In some implementations, at least one sensor may be downstream of the diverter 1102. For instance, a sensor could be positioned downstream of the diverter 1102 in the flow of the production fluid 1120 and/or a sensor could be positioned downstream of the diverter 1102 in the flow of the nonproduction fluid 1122. Such sensors could be downhole and/or at the surface of the well. In some implementations, at least one sensor may be upstream of the diverter 1102.

FIGS. 12A-12E are examples of different floats and flow diverters, according to some embodiments. The example floats and flow diverters of FIGS. 12A-12E may be used to assist in separating the production fluid from the nonproduction fluid. These example floats and flow diverters of FIGS. 12A-12E may also be used to create a more laminar flow.

In some implementations, the diverter blade configurations of FIGS. 12A-12E may replace the floats 504-1104 of FIGS. 5-11, respectively. Alternatively or in addition, the diverter blade configurations of FIGS. 12A-12E may be used to create a more laminar flow down stream of the floats 504-1104 of FIGS. 5-11, respectively. Alternatively or in addition, the diverter blade configurations of FIGS. 12A-12E may be used to create a more laminar flow downstream of the floats 504-1104 of FIGS. 5-11, respectively. Accordingly, these diverter blade configurations of FIGS. 12A-12E may be used to separate the production fluid from the nonproduction fluid and/or to reduce the turbulence of the flows. Such floats may assist in the separation of production fluid and nonproduction fluid by deacceleration and/or acceleration of the flow. These diverter blades of FIGS. 12A-12E may include fluid therein so that they float about their axis.

Figure 12A:
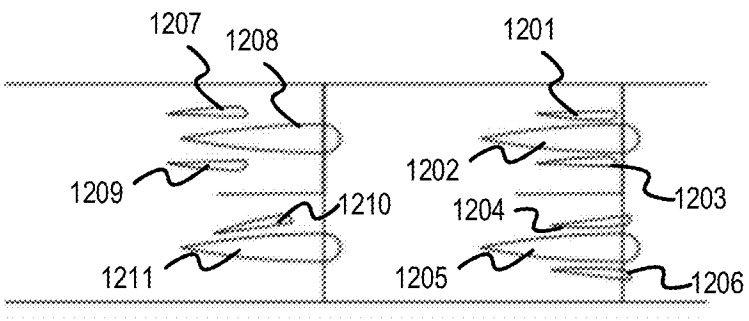
FIGS. 12A-12E are examples of different floats and flow diverters, according to some embodiments.
Figure 12B:
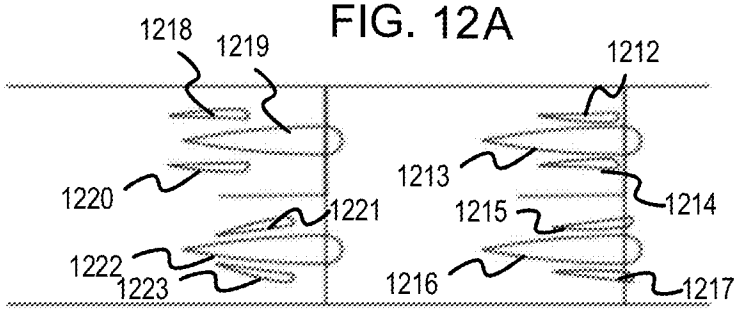
Figure 12C:
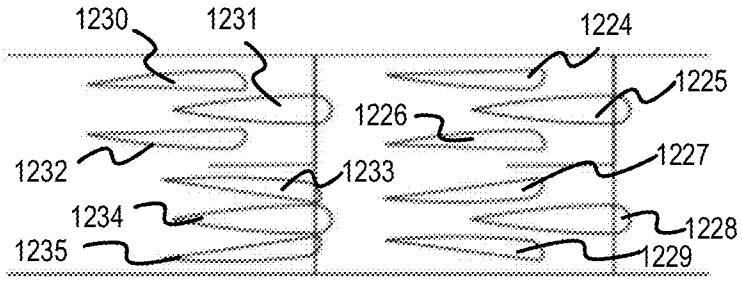

FIG. 12A depicts a first example of a diverter blade configuration that includes a first group of diverter blades 1201-1206 followed by a second group of diverter blades 1207-1211. FIG. 12B depicts a second example of a diverter blade configuration that includes a first group of diverter blades 1212-1217 followed by a second group of diverter blades 1218-1223. FIG. 12C depicts a third example of a diverter blade configuration that includes a first group of diverter blades 1224-1229 followed by a second group of diverter blades 1230-1235.

Figure 12D:
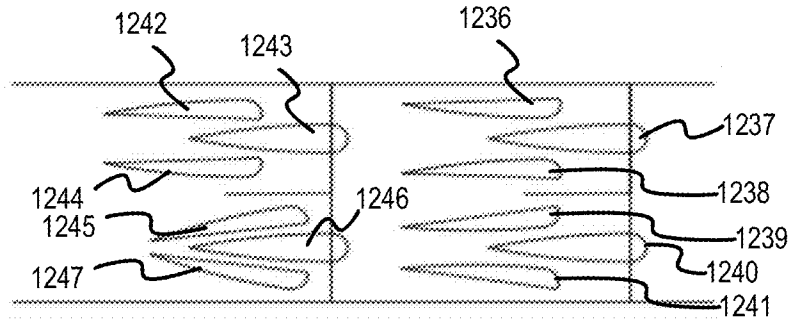
Figure 12E:
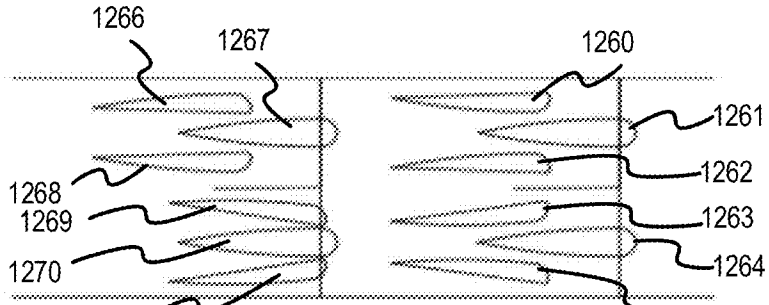

FIG. 12D depicts a fourth example of a diverter blade configuration that includes a first group of diverter blades 1236-1241 followed by a second group of diverter blades 1242-1247. FIG. 12E depicts a sixth example of a diverter blade configuration that includes a first group of diverter blades 1260-1265 followed by a second group of diverter blades 1266-1271.

The one or more diverters, diverter systems, systems that employs one or more diverters may have a diverter located or positioned at one or more location to perform one or more functions. For example, there may be one or more diverters located ahead of a horizontal, gravity-type separator. The diverters may help segregate the oil-cut and water-cut fluids. The flow diverter may assist in decreasing the turbulence of fluids, fluid flows or streams (such as the oil-cut and water-cut fluids streams). The diverters may assist in settling solids from a flow. The diverters may have coalescing features. The diverters may have debris catching features. The diverters may have debris storage features. The features may be other features to assist in destabilizing turbulence. In some embodiments, there may be one or more diverters located ahead of a horizontal, gravity-type separator for one or both the oil-cut and water-cut fluids streams. In some embodiments, there may be one or more diverters located ahead, within, or after a DOWSS system of a horizontal, gravity-type separator for one or both the oil-cut and water-cut fluids streams.

In some implementations, there may be one or more diverters located ahead, within, after a horizontal, gravity-type separator for one or both the oil-cut and water-cut fluids streams. In some implementations, there may be one or more diverters located ahead, within, or after a DOWSS of any type of horizontal solids and/or fluids separator. In some implementations, there may be one or more diverters located within a horizontal, gravity-type separator for one or both the oil-cut and water-cut fluids streams. In some implementations, there may be one or more diverters located within a horizontal, gravity-type separator for formation fluids.

In some implementations, there may be one or more diverters located ahead, within, after a non-horizontal, non-gravity-type separator for one or both the oil-cut and water-cut fluids streams. In some implementations, there may be one or more diverters located ahead, within, or after a DOWSS of any type of non-horizontal solids and/or fluids separator. In some implementations, there may be one or more diverters located within a non-horizontal, non-gravity-type separator for one or both the oil-cut and water-cut fluids streams. In some implementations, there may be one or more diverters located within a non-horizontal, non-gravity-type separator for formation fluids.

In some implementations, there may be one or more diverters located within a horizontal, gravity-type separator for solids separation and/or processing. In some implementations, there may be one or more diverters located within a substantially horizontal, gravity-type separator to reduce or increase turbulence or another property of one or more fluids. For example, in some implementations, the one or more diverters may be located in a separator that is strictly horizontal or off horizontal by a defined number degrees (such as +/−5 degrees, +/−20 degrees, etc.). In some implementations, there may be one or more diverters located within a horizontal DOWSS component. In some implementations, there may be one or more diverters located within a horizontal DOWSS component for solids separation. In some implementations, there may be one or more diverters located within a horizontal DOWSS component for fluids separation. There may be one or more diverters located within a horizontal well or horizontal well section with gravity-type separator(s). There may be one or more diverters located within a horizontal DOWSS component to reduce or increase turbulence or change another property of one or more fluids.

In some embodiments, there may be one or more diverters located ahead of a horizontal separator (of any kind or combination thereof) for one or both the oil-cut and water-cut fluids streams. In some embodiments, there may be one or more diverters located ahead, within, or after a DOWSS of a horizontal separator (of any kind or combination thereof) for one or both the oil-cut and water-cut fluids streams.

In some embodiments, there may be one or more diverters located ahead, within, after a horizontal separator (of any kind or combination thereof) for one or both the oil-cut and water-cut fluids streams. In some embodiments, there may be one or more diverters located ahead, within, or after a DOWSS of any type of horizontal solids and/or fluids separator.

There may be one or more diverters located within a horizontal separator (of any kind or combination thereof) for one or both the oil-cut and water-cut fluids streams. In some implementations, there may be one or more diverters located within a horizontal separator (of any kind or combination thereof) for formation fluids. In some implementations, there may be one or more diverters located within a horizontal separator (of any kind or combination thereof) for solids separation and/or processing.

In some implementations, there may be one or more diverters located within a horizontal separator (of any kind or combination thereof) to reduce/increase turbulence or another property of one or more fluids. In some implementations, there may be one or more diverters located within a horizontal DOWS (of any kind or combination thereof). In some implementations, there may be one or more diverters located within a horizontal DOWSS for solids separation. In some implementations, there may be one or more diverters located within a horizontal DOWSS for fluids separation. In some implementations, there may be one or more diverters located within a horizontal well or horizontal well section. In some implementations, there may be one or more diverters located within a horizontal DOWSS to reduce or increase turbulence or change another property of one or more fluids.

In some implementations, there may be one or more diverters located ahead of an inclined separator (of any kind or combination thereof) for one or both the oil-cut and water-cut fluids streams. Inclined may be defined as any angle that is not vertical. For example, inclined may include less than 90 degrees, more than 105 degrees, less than 10 degrees from vertical, an S-well, an tangential portion of the well, extended reach, etc. In some implementations, there may be one or more diverters located ahead, within, or after a DOWSS of an inclined separator for one or both the oil-cut and water-cut fluids streams. In some implementations, there may be one or more diverters located ahead, within, or after an inclined separator for one or both the oil-cut and water-cut fluids streams. In some implementations, there may be one or more diverters located ahead, within, or after a DOWS of any type for solids and/or fluids separation and/or processing and/or removal.

In some implementations, there may be one or more diverters located within an inclined separator (of any kind or combination thereof) for one or both the oil-cut and water-cut fluids streams. In some implementations, there may be one or more diverters located within an inclined separator (of any kind or combination thereof) for formation fluids. In some implementations, there may be one or more diverters located within an inclined separator (of any kind or combination thereof) for solids separation and/or processing. In some implementations, there may be one or more diverters located within an inclined separator (of any kind or combination thereof) to reduce/increase turbulence or another property of one or more fluids. In some implementations, the diverters may have a feature to rotate portions of the diverter along the wellbore's axis (or the longitudinal axis of the diverter).

In some implementations, there may be one or more diverters located within an inclined DOWSS. In some implementations, there may be one or more diverters located within an inclined DOWSS for solids separation. In some implementations, there may be one or more diverters located within an inclined DOWSS for fluids separation.

In some implementations, there may be one or more diverters located within an inclined well or inclined well section. In some implementations, there may be one or more diverters located within an inclined DOWS or DOWSS system or component (of any kind or combination thereof) to reduce or increase turbulence or change another property of one or more fluids.

In some implementations, there may be one or more diverters located ahead of a vertical or near vertical separator (of any kind or combination thereof) for one or both the oil-cut and water-cut fluids streams. In some implementations, there may be one or more diverters located ahead, within, after DOWS and/or DOWSS systems of a vertical or near vertical separator (of any kind or combination thereof) for one or both the oil-cut and water-cut fluids streams.

In some implementations, there may be one or more diverters located ahead, within, after a vertical or near vertical separator (of any kind or combination thereof) for one or both the oil-cut and water-cut fluids streams. In some implementations, there may be one or more diverters located ahead, within, and/or after DOWS and/or DOWSS systems of any type for solids and/or fluids separation and/or processing and/or removal. In some implementations, there may be one or more diverters located within a vertical or near vertical (of any kind or combination thereof) for one or both the oil-cut and water-cut fluids streams.

In some implementations, there may be one or more diverters located within a vertical or near vertical (of any kind or combination thereof) for formation fluids. In some implementations, there may be one or more diverters located within a vertical or near vertical (of any kind or combination thereof) for solids separation and/or processing. In some implementations, there may be one or more diverters located within a vertical or near vertical (of any kind or combination thereof) to reduce or increase turbulence or another property of one or more fluids. In some implementations, there may be one or more diverters located within a vertical or near vertical DOWS or DOWSS system or component (of any kind or combination thereof). In some implementations, there may be one or more diverters located within a vertical or near vertical DOWS or DOWSS system or component (of any kind or combination thereof) for solids separation.

In some implementations, there may be one or more diverters located within a vertical or near vertical DOWS or DOWSS system or component (of any kind or combination thereof) for fluids separation. In some implementations, there may be one or more diverters located within a vertical or near vertical wells or near vertical well section(s). In some implementations, there may be one or more diverters located within a vertical or near vertical DOWS or DOWSS system or component (of any kind or combination thereof) to reduce or increase turbulence or change another property of one or more fluids.

In some implementations, there may be one or more diverters located ahead of a subsea (residing on or near the sea floor) separator (of any kind or combination thereof) for one or both the oil-cut and water-cut fluids streams. In some implementations, there may be one or more diverters located ahead, within, after DOWS and/or DOWSS systems of a vertical or near a subsea (residing on or near the sea floor) separator (of any kind or combination thereof) for one or both the oil-cut and water-cut fluids streams. In some implementations, the oil-cut fluid may comprise solids-bearing oil-cut fluid. In some implementations, there may be one or more diverters located ahead, within, after a vertical or near a subsea (residing on or near the sea floor) separator (of any kind or combination thereof) for one or both the oil-cut and water-cut fluids streams.

In some implementations, there may be one or more diverters located ahead, within, and/or after DOWS and/or DOWSS systems of any type for solids and/or fluids separation and/or processing and/or removal. In some implementations, there may be one or more diverters located within a subsea installation (residing on or near the sea floor) (of any kind or combination thereof) for one or both the oil-cut and water-cut fluids streams. In some implementations, there may be one or more diverters located within a subsea (residing on or near the sea floor) (of any kind or combination thereof) for formation fluids.

In some implementations, there may be one or more diverters located within a subsea system, installation, device, etc. (residing on or near the sea floor) (of any kind or combination thereof) for solids separation and/or processing. In some implementations, there may be one or more diverters located within a subsea (residing on or near the sea floor) (of any kind or combination thereof) to reduce or increase turbulence or another property of one or more fluids. In some implementations, there may be one or more diverters located within a subsea (residing on or near the sea floor) DOWS or DOWSS system or component (of any kind or combination thereof). In some implementations, there may be one or more diverters located within a subsea (residing on or near the sea floor) DOWS or DOWSS system or component (of any kind or combination thereof) for solids separation.

In some implementations, there may be one or more diverters located within a subsea (residing on or near the sea floor) DOWS or DOWSS system or component (of any kind or combination thereof) for fluids separation. In some implementations, there may be one or more diverters located within a subsea (residing on or near the sea floor). In some implementations, there may be one or more diverters located subsea (residing on or near the sea floor) DOWS or DOWSS system or component (of any kind or combination thereof) to reduce or increase turbulence or change another property of one or more fluids.

In some implementations, there may be one or more diverters located subsea (residing on or near the sea floor). The system and/or features of the system may comprise one or more of the following: a prime mover to provide power or movement to one or more components of a diverter and/or related components, components and space for the diverter and/or component(s) (fin(s), foil, flap, coalescer, hinge, arm, swivel, actuator, frame, nozzle, flusher, inlet, outlet, debris catcher, collector, transfer mechanism, etc.) to move and/or be articulated, rotated, raised, lowered, tilted, etc., controller, power source (such as electric conductor, hydraulic line, etc.), sensor(s) for position, vibration, strain, temperature, force, torque, velocity, acceleration, etc., one or more materials selected for one or more properties (such as density, buoyancy, corrosion resistance, erosion resistance, manufacturability, friction reduction, smoothness, surface condition (i.e. smooth, slippery, etc.).

In some implementations, there may be one or more diverters located ahead of a lateral wellbore separator (of any kind or combination thereof) for one or both the oil-cut and water-cut fluids streams. In some implementations, there may be one or more diverters located ahead, within, after DOWS and/or DOWSS systems of a lateral wellbore separator (of any kind or combination thereof) for one or both the oil-cut and water-cut fluids streams. In some implementations there may be one or more diverters located ahead, within, after lateral wellbore separator (of any kind or combination thereof) for one or both the oil-cut and water-cut fluids streams.

In some implementations, there may be one or more diverters located ahead, within, and/or after DOWS and/or DOWSS systems of any type for solids and/or fluids separation and/or processing and/or removal. In some implementations, there may be one or more diverters located within a lateral wellbore (of any kind or combination thereof) for one or both the oil-cut and water-cut fluids streams. In some implementations, there may be one or more diverters located within a lateral wellbore (of any kind or combination thereof) for formation fluids. In some implementations, there may be one or more diverters located within a lateral wellbore (of any kind or combination thereof) for solids separation and/or processing.

In some implementations, there may be one or more diverters located within lateral wellbore (of any kind or combination thereof) to reduce or increase turbulence or another property of one or more fluids. In some implementations, there may be one or more diverters located within a lateral wellbore DOWS or DOWSS system or component (of any kind or combination thereof). In some implementations, there may be one or more diverters located within a lateral wellbore DOWS or DOWSS system or component (of any kind or combination thereof) for solids separation. In some implementations, there may be one or more diverters located within a lateral wellbore DOWS or DOWSS system or component (of any kind or combination thereof) for fluids separation. In some implementations, there may be one or more diverters located within a lateral wellbore or well bore section(s). In some implementations, there may be one or more diverters located within a lateral wellbore DOWS or DOWSS system or component (of any kind or combination thereof) to reduce or increase turbulence or change another property of one or more fluids.

In some implementations, the diverter, diverter system and/or features of the system may comprise one or more of the following: a prime mover to provide power or movement to one or more components of a diverter and/or related components, components and space for the diverter and/or component(s) (fin(s), foil, flap, coalescer, hinge, arm, swivel, actuator, frame, nozzle, flusher, inlet, outlet, debris catcher, collector, transfer mechanism, etc.) to move and/or be articulated, rotated, raised, lowered, tilted, etc., controller, power source (such as an electric conductor, hydraulic line, etc.), sensor(s) for position, vibration, strain, temperature, force, torque, velocity, acceleration, etc., one or more materials selected for one or more properties (i.e. density, buoyancy, corrosion resistance, erosion resistance, manufacturability, friction reduction, smoothness, surface condition (such as smooth, slippery, etc.), communication component (communication line, computer memory, input and output ports, hardware, seals, etc.), etc.

In some implementations, the separators, pumps, and injector may be installed at the junction between the main bore and the lateral bore. In other implementations, such devices may be installed below this junction or above this junction. Further, the main bore or one or more lateral bores may include one or more orientation devices which provides depth and orientation control. While example implementations include a given gravity-type separator, other types of separators may be used. For example, other gravity-type separators and other non-gravity separators may be used.

Example Operations

Figure 13:
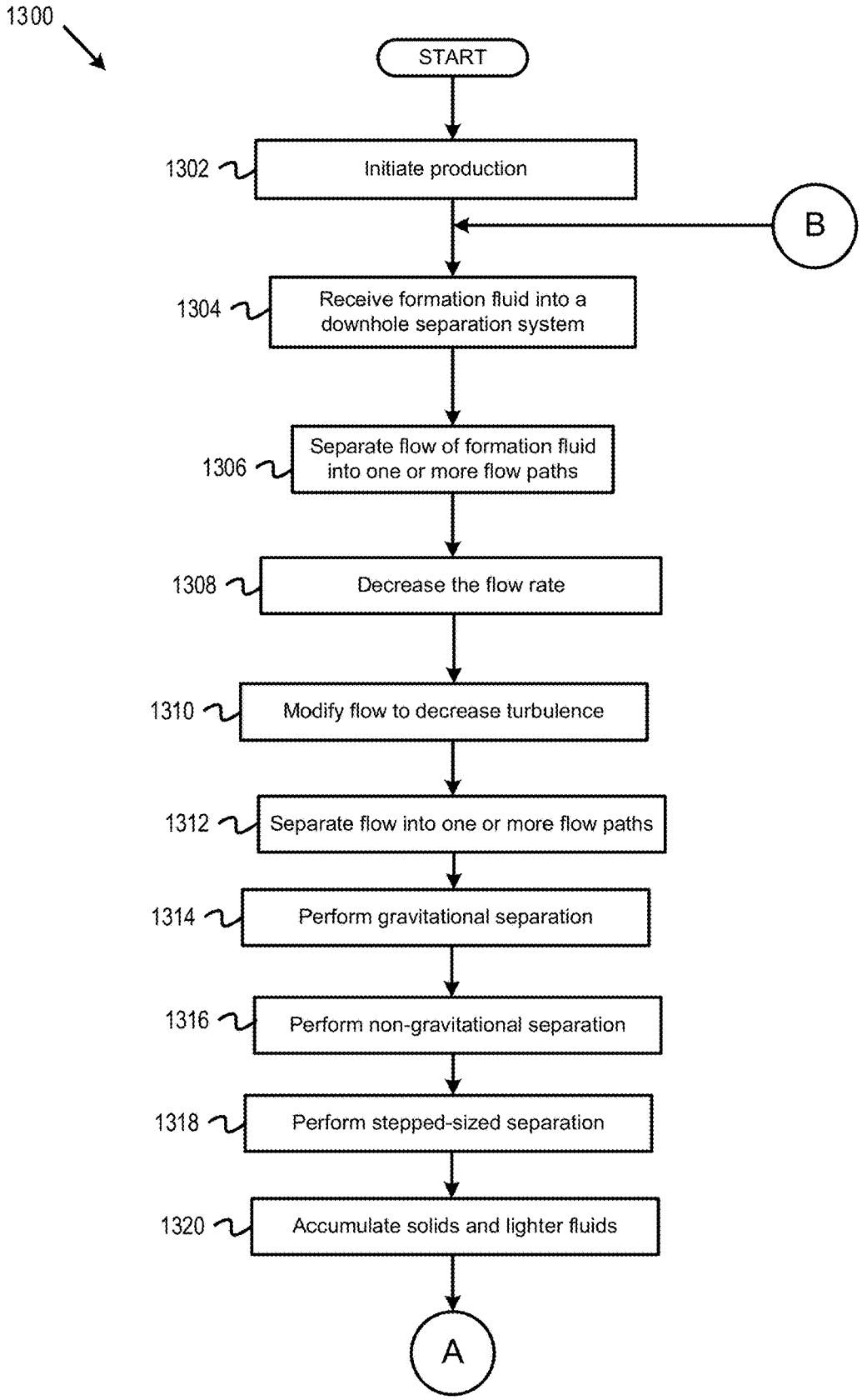
FIGS. 13-14 is a flowchart of example operations for downhole fluid and solid separation, according to some embodiments.
Figure 14:
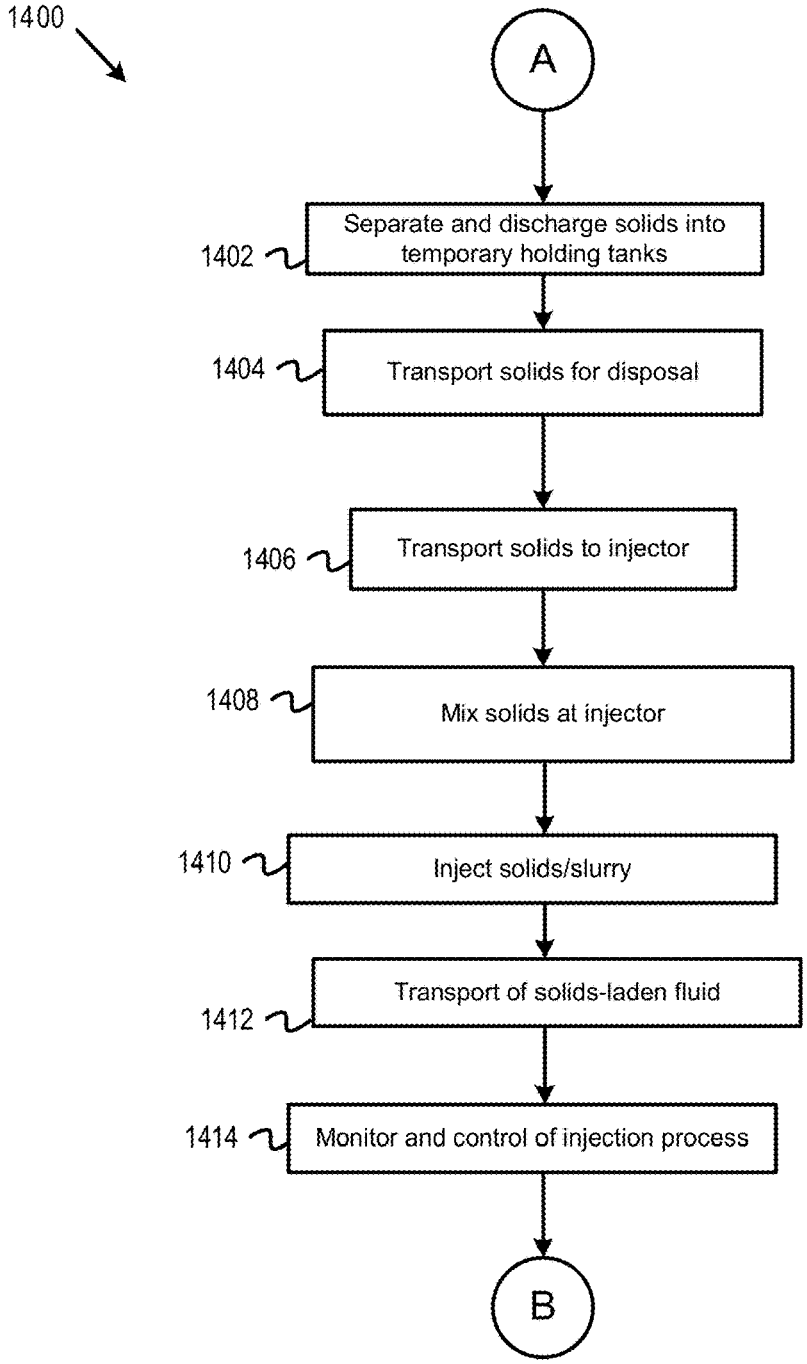

Example operations are now described. FIGS. 13-14 is a flowchart of example operations for downhole fluid and solid separation, according to some embodiments. Flowcharts 1300-1400 of FIGS. 13-14, respectively, are described in reference to FIGS. 1-2. However, other systems and components can be used to perform the operations now described. Operations of the flowcharts 1300-1400 continue between each other through transition points A and B. Operations of the flowchart 1300 start at block 1302.

At block 1302, production is initiated. For example, with reference to FIGS. 1-2, production may be initiated by the formation fluid 118 entering the main bore 102 and/or the lateral bore 104.

At block 1304, formation fluid is received into a downhole separation system. For example, with reference to FIGS. 1-2, the formation fluid 118 may be received into the separation system 124.

At block 1306, flow of formation fluid is separated into one or more flow paths. For example, with reference to FIGS. 1-2, the formation fluid 118 may flow into the fluid separator 296, wherein most or at least a majority of the production fluid 114 may separate into a flow above the separator 201, while most or at least a majority of the nonproduction fluid with sediment 294 may separate into a separate flow below the separator 201. Accordingly, if the formation fluid is at least partially segregated into oil-cut and water-cut, example implementations may take advantage of such a segregation to separate these fluids into two flow paths. Lower-density (oil-cut) fluids may flow through a top flow path. Higher-density (water-cut) may flow through a bottom flow path.

At block 1308, the flow rate is decreased. For example, with reference to FIG. 2, the formation fluid 118 moves from a smaller to a larger diameter of the tubing 287. This may decrease the velocity of the flow of the formation fluid 118—which allows the separation. In particular, most or at least a majority of the production fluid 114 may separate into a flow above the separator 201, while most or at least a majority of the nonproduction fluid with sediment 294 may separate into a separate flow below the separator 201. This allows most of the sediment to be captured in the lower portion of the tubing 287 (below the separator 201). Accordingly, example implementations may reduce flow from a high-turbulent flow to a slower, less turbulent flow. Example implementations may provide more flow area (an increased pipe inner diameter, increased wellbore size, multilateral wellbore for settling ponds, distributing flow, etc.). Example implementations may also provide more time (start and stop flow, slow pumping action, etc.). Accordingly, example implementations may cause the flow to stop temporally so fluids may separate. The flow stoppage may be implemented by stopping a downhole pump. In some implementations, the flow may be slowed by reducing the speed of the downhole pump.

At block 1310, flow is modified to decrease turbulence. For example, example implementations may also destabilize turbulence and reduce flow from a turbulent flow to a laminar flow (or transitional flow) by one or means (including those mentioned above).

At block 1312, flow is separated into one or more flow paths. For example, with reference to FIG. 2, the formation fluid 118 may be separated into one or more flow paths via the fluid separator 296. Such separation may be applicable to different flows (e.g., formation fluids, oil-cut, water-cut, gas, liquid, liquid-gas, slurries (solids-laden fluids, production fluids, fluids to be disposed, fluids to be injected, etc.).

At block 1314, gravitational separation is performed. For example, with reference to FIG. 2, the fluid separator 296 may comprise a gravity-based separation that includes the separator 201.

At block 1316, non-gravitational separation is performed. For example, with reference to FIG. 2, the formation fluid 118 may be separated using different types of non-gravitational operations.

At block 1318, stepped-sized separation is performed. For example, with reference to FIG. 2, the sediment separators 290A-290N may separate the sediment 294 from the non-production fluid 116. For example, the sediment separators 290A-290N may separate out the largest or densest solids first, then separate out the next largest or densest solids, etc. Example implementations may include allowing for settling and separation of solids to separate from fluid stream(s). Additionally, example implementations may allow time for the largest and/or densest solids to settle out from fluids. Example implementations may also allow lower flow rates to assist with the separation. Example implementations may use the sediment separators 290A-290N to allow the largest and/or densest solids to settle out, accumulate and be trapped. Example implementations may include allowing time for lighter fluids and gases to begin to segregate and separate from heavier fluids. Example implementations may include means, methods, and devices to subject one or more fluids to one or more force, acceleration, path (e.g., tortuous path, etc.), velocity, pressure, restriction (e.g., screen opening(s), screen size, nozzle, etc.), time, impulse, change in one or more of the above including step change, gradual change, etc. Example implementations may separate based on at least one of density, size, shape, surface tension, molecular makeup, other chemical, physical, molecular, electron properties, etc.

At block 1320, solids and lighter fluids are accumulated. For example, with reference to FIG. 2, the different sediment separators 290A-290N may accumulate the sediment.

Operations of the flowchart 1300 continue at transition point A, which continues at transition point A of FIG. 14. From transition point A of FIG. 14, operations continue at block 1402.

At block 1402, solids are separated and discharged into temporary holding tanks. For example, with reference to FIGS. 1-2, the different sediment separators 290A-290N may include temporary holding tanks for storing the separated out solids. Example implementations may include utilizing an auger, drag chain, an inclined plane, a jetting device, etc. to keep the solids or slurry from accumulating at the discharge end of the solid separation device which may cause the device to plug and become inoperable.

At block 1404, solids are transported for disposal. For example, with reference to FIG. 2, these different collections of the sediment by the different sediment separators 290 may be injected into a same or different line or tubing for disposal. As shown, the sediment injector(s) 299 are coupled to receive the sediment collected by the different sediment separators 290.

At block 1406, solids are transported to an injector. For example, with reference to FIGS. 1-2, the sediment may be transported to the sediment injectors 299.

At block 1408, solids may be mixed at the injector. For example, with reference to FIG. 2, the sediment 295 may be mixed at the sediment injector 299. For example, the sediment 295 may be mixed with fluid (such as production fluid, nonproduction fluid, etc.). In some implementations, one or more type of mixers may be used. For example, a mechanical mixer, a fluid-type mixer, etc. may be used to mix the sediment 295 with fluid. In some implementations, solids may be stored in or near the injector 299 so that mixing may progress smoothly or consistently at a defined rate. For example, the solids may be stored in an enclosed tank, gravity-fed tank, auger-fed tank, etc.

At block 1410, solids (or slurry) are injected. For example, with reference to FIGS. 1-2, the sediment injectors 299 may deliver the sediment to a different downhole location (such as a different lateral well, a thief zone (having a high porosity, high permeability downhole zone that may include a low pressure), etc.). In some implementations, sediment may be disposed to different locations depending on their size. For example, for sediment having a size greater than X, such solids may be delivered to the surface of the multilateral well for disposal. For sediment having a size less than X but greater than Y, such sediment may be disposed in a first downhole location (such as a thief zone). For the remaining sediment that have a size less than Y, such solids may be disposed in a second downhole location (such as a lateral well).

At block 1412, solids-laden fluid is transported. For example, with reference to FIGS. 1-2, the sediment injector (s) 299 may dispose of these sediments by injecting them into a tubing for delivery to the surface of the multilateral well. For example, the sediment may be delivered to the surface using the production tubing or a separate tubing. If the production tubing is used, the solids may be included with the production fluid that is being delivered to the surface. In such implementations, separation operations may be performed at the surface to separate out the solids from the production fluid 114. Accordingly, if sediment is being included with the production fluid 114 being delivered to the surface, the production fluid 114 may be delivered to surface equipment that provides for separation of the sediment. Alternatively, during the time when the sediment is not being included with the production fluid 114, the production fluid 114 may be delivered to different surface equipment that does not include such separation of sediment.

In some implementations, the sediment injectors 299 may inject the solids or slurry into a string or tubular (e.g., a production tubing). Timing of the injection may be coordinated with production of production fluid. For example, a pump may switch between pumping (in the production tubing) production fluid to the solid-laden fluid. Example implementations may include communications to the surface regarding the switching, the volume of the solids, fluids, slurry to be pumped, how much has been pumped, how much remains to be pumped, etc. Additionally, some implementations may enable communication from the surface to downhole to control and override the switching.

At block 1414, injection process is monitored and controlled. For example, with reference to FIGS. 1-2, controllers may be coupled to the sediment injectors 299 for monitoring and controlling the injection and disposal of the sediment (either to the surface of the multilateral well or to a disposal location downhole).

Operations of the flowchart 1400 continue at transition point B, which continues at transition point B of FIG. 13. From transition point B of FIG. 13, operations return to operations at block 1304.

Figure 15:
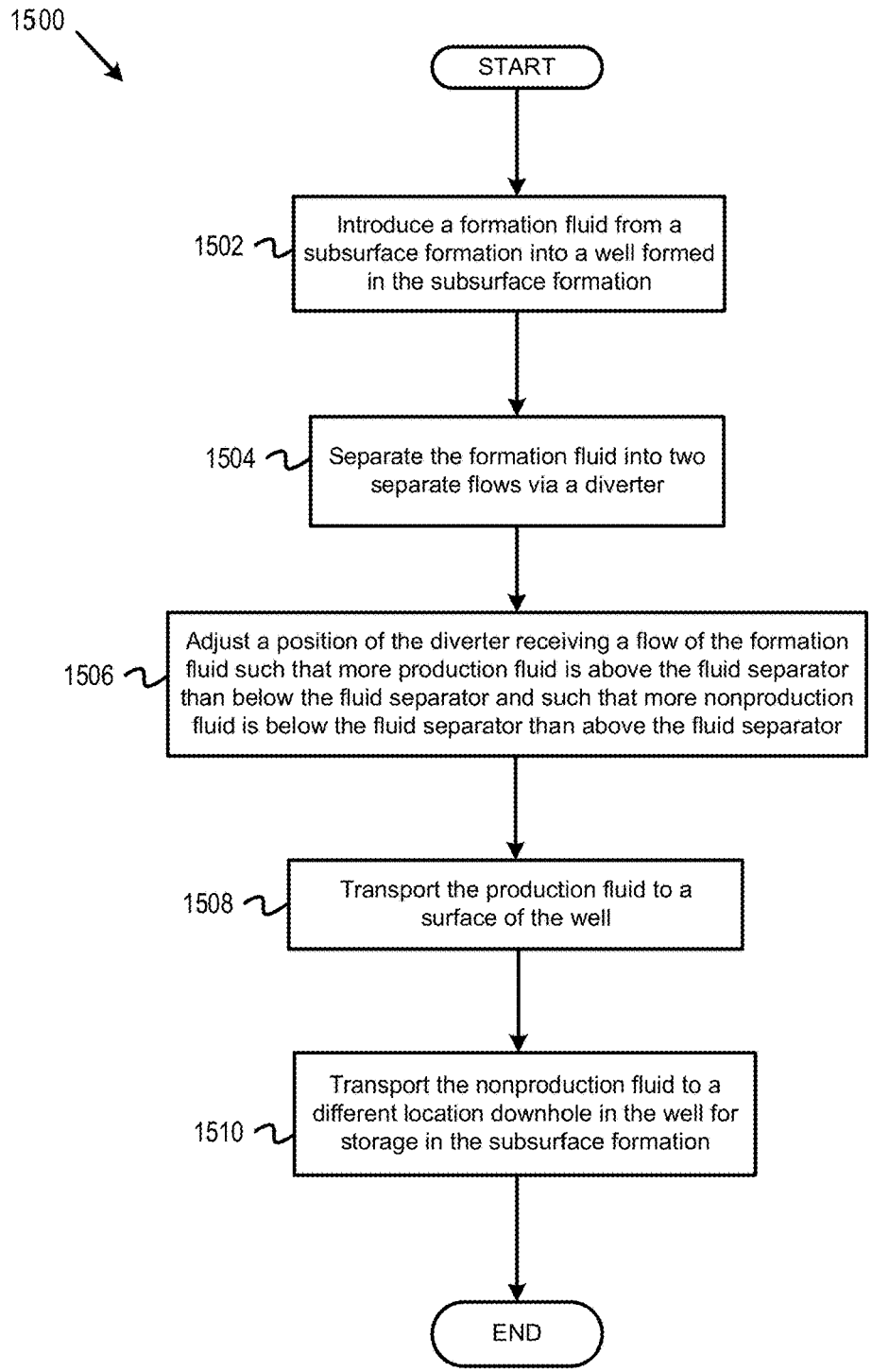
FIG. 15 is a flowchart of example operations for using a downhole diverter for separation and transporting of production fluid and nonproduction fluid, according to some embodiments.

FIG. 15 is a flowchart of example operations for using a downhole diverter for separation and transporting of production fluid and nonproduction fluid, according to some embodiments. A flowchart 1500 of FIG. 15 is described in reference to FIGS. 5-7. However, other systems and components can be used to perform the operations now described. Operations of the flowchart 1500 start at block 1502.

At block 1502, a formation fluid from a subsurface formation is introduced into a well formed in the subsurface formation. For example, with reference to FIG. 5, the formation fluid 501 is introduced into the well from the surrounding subsurface formation.

At block 1504, the formation fluid is separated into two separate flows via a diverter. For example, with reference to FIG. 5, the diverter 502 separates the formation fluid 501 into two separate flows (the production fluid 520 and the nonproduction fluid 522). Ideally, the formation fluid will separate into two separate flows. However, this fluid will typically include more than just two. Also, depending upon such variables as temperature, pressure, chemical composition, etc., the formation fluid may comprise one or more of the following combinations: 1) oil and water being immiscible, 2) gas being miscible with water (typically in small quantities), 3) gas is miscible with oil (typically in large quantities), etc. For example, at a given pressure and temperature, oil and water may absorb a given amount of gas until the oil and water are saturated with gas. Above this gas saturation concentration limit, gas cannot mix further and stays as a separate gas phase. So for a given pressure and temperature, there can be up to three phases: 1) oil with gas in solution (traditionally called oil), 2) water with a small quantity of gas in solution (traditionally called water), and 3) free gas—gas.

In some implementations, the production fluid 520 is primarily oil (oil with gas in solution). In some implementations, the nonproduction fluid 522 is primarily water (water with a small quantity of gas in solution). Additionally, the nonproduction fluid 522 may include salts. Also, produced water may include soluble and non-soluble oil/organics, suspended solids, dissolved solids, etc.

At block 1506, a position of the diverter receiving flow of the formation fluid is adjusted such that more production fluid is above the fluid separator than below the fluid separator and such that more nonproduction fluid is below the fluid separator than above the fluid separator. For example, with reference to FIG. 6, there is more production fluid 520 in the formation fluid 501. Accordingly, the diverter 502 moves down in the flow so that the production fluid 520 and the nonproduction fluid 522 is above and below the diverter 502, respectively. With reference to FIG. 7, there is more nonproduction fluid 522 in the formation fluid 501. Accordingly, the diverter 502 moves up in the flow so that the production fluid 520 and the nonproduction fluid 522 is above and below the diverter 502, respectively. As described above, this adjustment of the position of the diverter 502 may be self-adjusting (based on the float 504 and/or the diverter fin 505 including fluid (such as production fluid or a fluid having a viscosity and/or density that is the same or substantially the same as viscosity and/or density as the production fluid. Alternatively or in addition, this adjustment of the position of the diverter 502 may be made by a controller based on sensors (as described above).

At block 1508, the production fluid is transported to a surface of the well. For example, with reference to FIG. 5, the production fluid 520 may be transported to a surface of the well (as described above).

At block 1510, the nonproduction fluid is transported to a different location downhole in the well for storage in the subsurface formation. For example, with reference to FIG. 5, the nonproduction fluid 522 may be transported to a different location downhole in the well for storage in the subsurface formation (as described above). For example, the nonproduction fluid 522 may be transported to a different bore of the multilateral well for storage in the subsurface formation surrounding the different bore. In some implementations, the nonproductive fluid 522 may transported to a different location for further processing such as removal of remaining oil, demulsification treatment, solids removal, etc.

Example Multilateral Wells

Example implementations may be performed in different Technology Advancement of Multilaterals (TAML) Level wells. In particular, multilateral wells are characterized according to definitions established in 1997 during a Technology Advancement of Multilaterals (TAML) Forum held in Aberdeen. These standards classify junctions as TAML Level 1, 2, 3, 4, 5, or 6 based on mechanical complexity, connectivity, and hydraulic isolation. The ascending order of these levels reflects increasing mechanical and pressure capability of the junction. Consequently, cost, complexity, and risk also generally increase at the higher TAML levels. However, other considerations of the well design also influence the overall complexity of the well—for example, a TAML Level 2 well with an advanced intelligent completion can be more complex and costly than a TAML Level 5 well with a simpler completion system.

In a TAML 1 well, the main bore, lateral, and junction are uncased. This basic lateral is designed to enhance reservoir drainage from consolidated formations. It has the advantage of low drilling and completion costs, but the open hole junction makes reentry into the lateral wellbore and control of flow from the lateral impossible.

Wells that have cased and cemented main bores and open hole laterals are designated TAML Level 2. A cemented main bore significantly reduces the risk of wellbore collapse and provides isolation between laterals. By placing sliding sleeves and packers in the main bore, operators can produce the bores singly or in commingle production.

Placing a liner in the lateral and mechanically connecting it to the cased and cemented main bore results in a TAML Level 3 well. A liner is a string of casing that does not extend to the surface but is anchored or suspended inside a previously run casing string. This TAML Level 3 well includes a lateral that is cased but not cemented at the junction. It is a relatively low-cost option that includes reentry capabilities and a lateral that is better supported than that of Levels 1 and 2. Using sliding sleeves and packer plugs, operators can produce the bores singly or in commingle production. A TAML Level 3 junction does not provide hydraulic isolation, and its use is restricted to consolidated formations.

TAML Level 4 junctions are applicable in both consolidated and unconsolidated formations because both the lateral and the main bore are cased and cemented at the junction. The junction provides full bore access to the lateral, and mechanical support is supplied by the tubulars and cement. However, because the cement can only withstand limited differential pressure, the junction does not provide hydraulic isolation.

TAML Level 5 wells do provide hydraulic isolation at the junction because pressure integrity is provided by the completion, which includes production tubing connecting a packer in the main wellbore above the junction and a packer in the lateral wellbore. Because hydraulic isolation and support are provided by the completion hardware, the junction may be a TAML Level 2, 3, or 4 before the Level 5 completion is installed. TAML Level 6 wells also provide hydraulic isolation at the junction. A well at this level differs from a TAML Level 5 well in that pressure integrity is provided by the main wellbore casing and a cemented or uncemented liner in the lateral. The cost and complexity of creating a single-metal-element dual-bore casing junction downhole has prevented TAML Level 6 wells from being developed. As of today, the category exists as a result of early experiments. Because multilateral wells that have higher TAML designations are generally more complex, they are more costly, and their configurations are more flexible. As they do with multilateral geometry, engineers choose a TAML level junction based primarily on reservoir characteristics, costs, and function.

The ability to reenter the lateral for well intervention operations is another multilateral well design consideration. Because it is a directionally drilled section that has no junction, the lower lateral is almost always easily accessed using standard intervention methods. Operators must make an economics-based decision during the well planning stage to include junctions that allow lateral access after pulling the upper completion, through-tubing access, junctions that can be adopted to allow access after installation or junctions through which no access is possible to main bore, lateral, or both. If the well includes more than one lateral, a selective through-tubing access system would need to be considered. The decision to deploy lateral junctions that allow full bore or restricted access is a function of the overall well design. Engineers usually opt for full bore access if a packer is to be placed below the junction or if an artificial lift system must be located near the lower lateral. In addition, based on their knowledge of the reservoir, operators may require full bore access to perform perforating, stimulation, logging, water shutoff, gravel packing, cleanout, and other remedial operations. Full bore access can be adapted to all TAML level junctions but must be specified before installation; some commercially available junctions allow no access or only restricted access to either the lateral or the main bore and cannot be adapted after installation.

The decision to use a multilateral well system and what type to use are the result of cost benefit analyses. In general, the less-complex junctions present operators with lower risks and costs. But risk mitigation and cost savings must be balanced against individual well and field development expectations. In low-value reservoirs, a simple open hole lateral that has no reentry capability may increase ultimate reserve recovery or accelerate production while having little impact on overall drilling and completion costs. In high-value deepwater plays, installing a hydraulically sealed TAML Level 5 or 6 junction can drive total well costs into millions of dollars and still be a good investment because it may save drilling another well with a complex and tortuous trajectory, preserve a well slot on an existing production platform, or eliminate the need entirely to procure and install additional subsea infrastructure.

In embodiments, a multilateral well is drilled and completed with a TAML Level 4 junction. The junction includes a pump and a fluid separator. The pump includes any pump capable of drawing in fluid through the pump intake, pressurizing it, and lifting it to the surface such as an electrical submersible pump, sucker-rod and pump jack, progressive cavity pump, gas lift and intermittent gas lift, reciprocating and jet hydraulic pumping systems, etc. The fluid separator and the pump can be above, at, or below the junction. The upper completion includes a retrievable electrical submersible pump packer while the lower completion has an orientation liner hanger or other orientation device.

While the aspects of the disclosure are described with reference to various implementations and exploitations, it will be understood that these aspects are illustrative and that the scope of the claims is not limited to them. Many variations, modifications, additions, and improvements are possible. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

In some implementations, a mechanical junction (not to be confused with the earthen junction of 2 earthen wellbores) may comprise a junction with a monolithic Y-Block. In some implementations, a monolithic Y-Block may provide for more robust connections to the other components of a junction assembly (i.e. main bore leg, lateral leg, tank, etc.).

Figure 16:
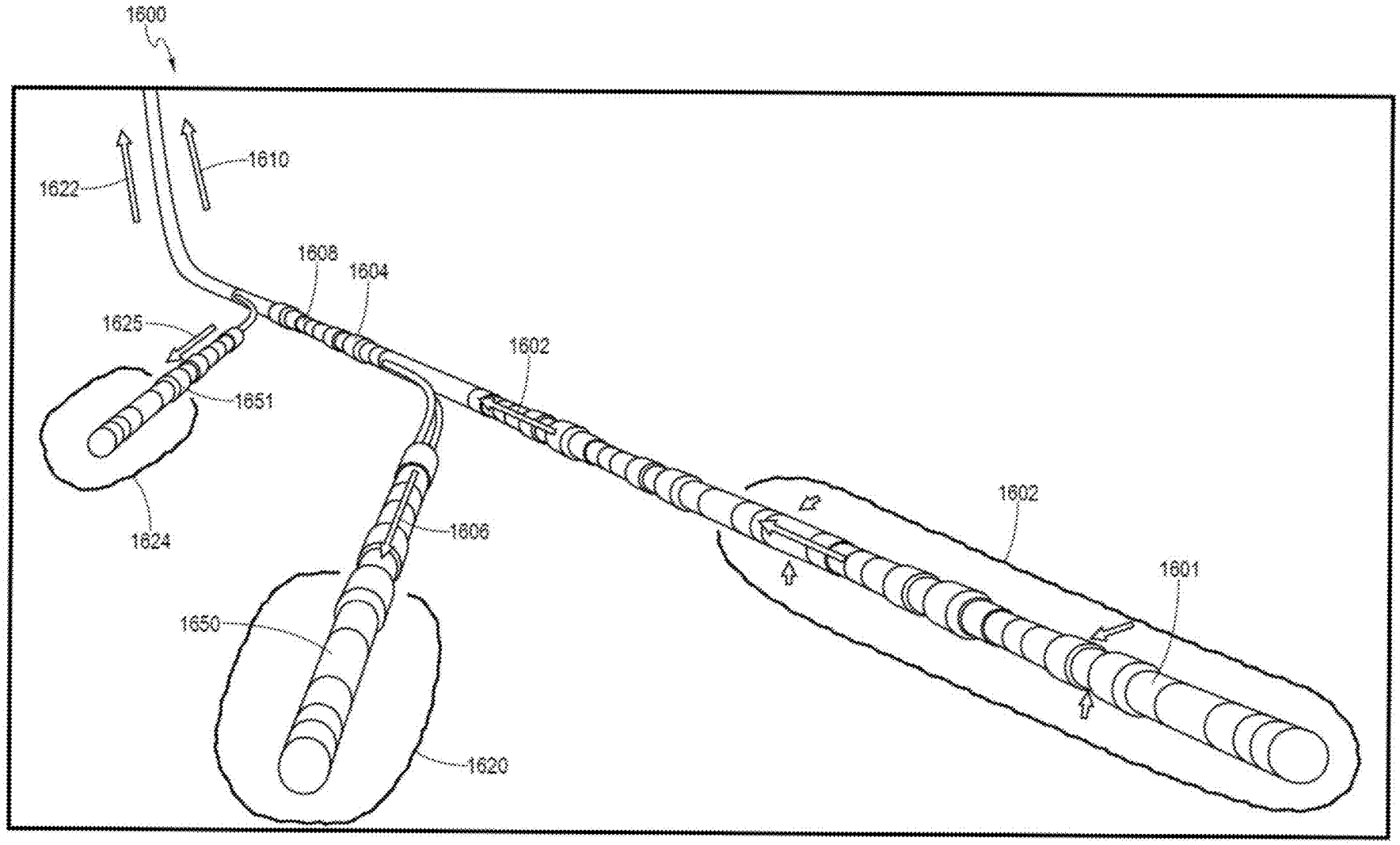
FIG. 16 is a perspective view of an example of a Level 5 (mechanical) junction assembly for use with a downhole oil, water and solids separator system, according to some embodiments.

To illustrate, FIG. 16 is a perspective view of an example of a Level 5 (mechanical) junction assembly for use with a downhole oil, water and solids separator system, according to some embodiments. FIG. 16 depicts a system 1600 having a multilateral well that includes a main bore 1601, a lateral bore 1650, and a lateral bore 1651. Formation fluid 1602 from the surrounding subsurface formation enters the main bore 1601. The formation fluid 1602 is transported through the main bore 1601 uphole to a level 5 monolithic Y-block 1604 and into a DOWSS 1608.

The DOWSS 1608 may process the formation fluid 1602 to separate out nonproduction fluid 1606 from production fluid 1622. The DOWSS 1608 may also process the formation fluid 1602 to separate sediment from at least one of the nonproduction fluid 1606 or the production fluid 1622. The DOWSS 1608 may transport the nonproduction fluid 1606 into the lateral bore 1650 for disposal in a disposal zone 1620 for the nonproduction fluid 1606 in the subsurface formation around the lateral bore 1650. The DOWSS 1608 may also transport sediment 1625 into the lateral bore 1651 for disposal in a disposal zone 1624 for the sediment 1625 in the subsurface formation around the lateral bore 1651. The DOWSS 1608 may also transport the production fluid 1622 and sediment 1510 to a surface of the multilateral well. Accordingly, in this example, the sediment may be disposed downhole into a highly permeable zone downhole and/or may be transported to the surface of the multilateral well or to a subsea or seafloor location.

Figure 17:
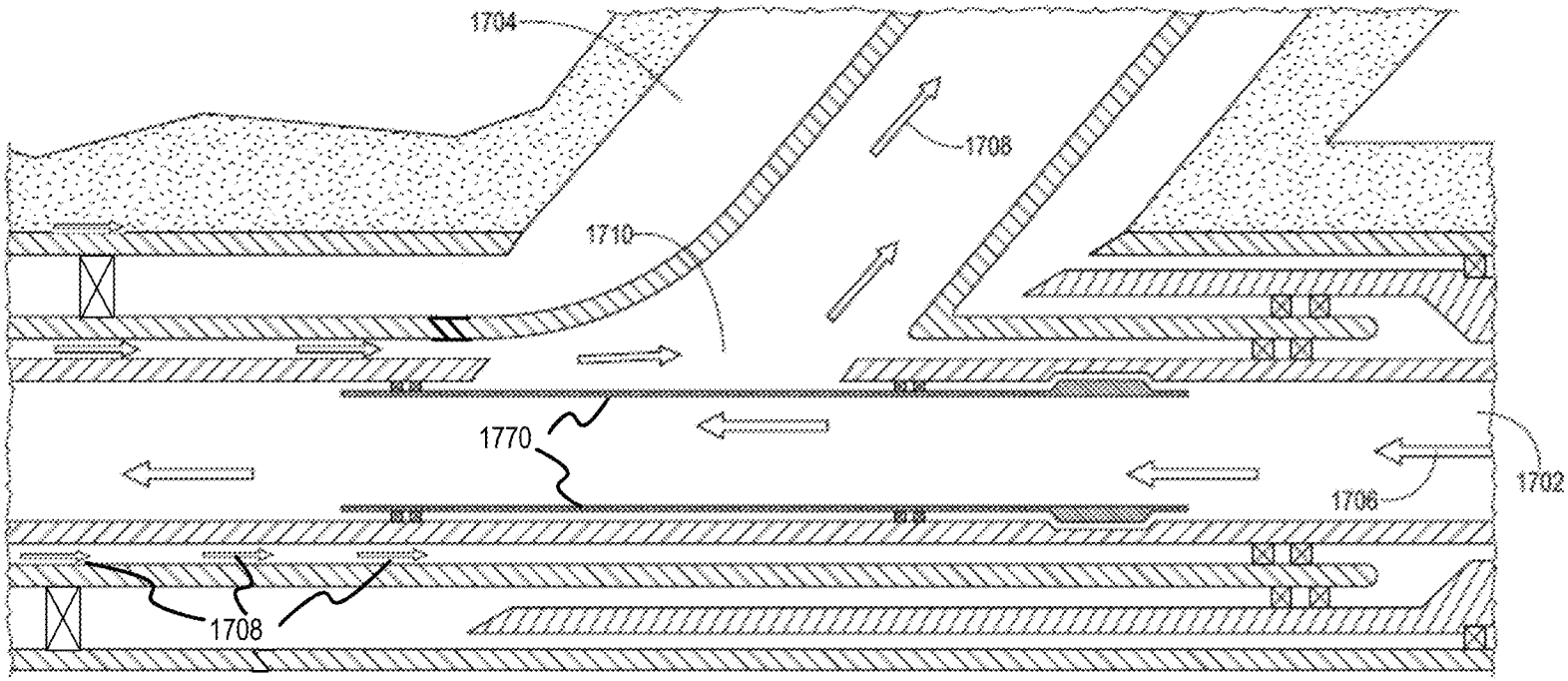
FIG. 17 is a cross-sectional view of an example of a Level 5 junction assembly for use with a downhole oil, water and solids separator system, according to some embodiments.

FIG. 17 is a cross-sectional view of an example of a Level 5 junction assembly for use with a downhole oil, water and solids separator system, according to some embodiments. In this embodiment, a main bore junction 1710 is used to provide a main bore 1702 for large tools to be passed through, or landed, in the y-block and/or main bore area of the junction 1710. A lateral bore 1704 is formed off the main bore 1702 at the junction 1710. In the example shown, an isolation sleeve 1770 may be landed in the junction. As shown, the isolation sleeve 1770 may provide pressure isolation between the formation fluids 1706 and the nonproduction fluids 1708. This main bore junction 1710 may be used with a variety of different Downhole Oil Water Separator Systems (DOWSS) and/or components including the DOWSS and/or its components (and/or with a DOWS system and/or components of the DOWS) disclosed within herein. The main bore junction 1710 may have a main bore leg inside diameter (ID) of 30% the outer diameter (OD) of the Junction's Y-Block. The main bore leg's ID may be 40% the OD of the Junction's Y-Block. The main bore leg's ID may be 50%, 53%, 55%, 60%, 67% or more of the Junction's Y-Block OD.

Figure 18:
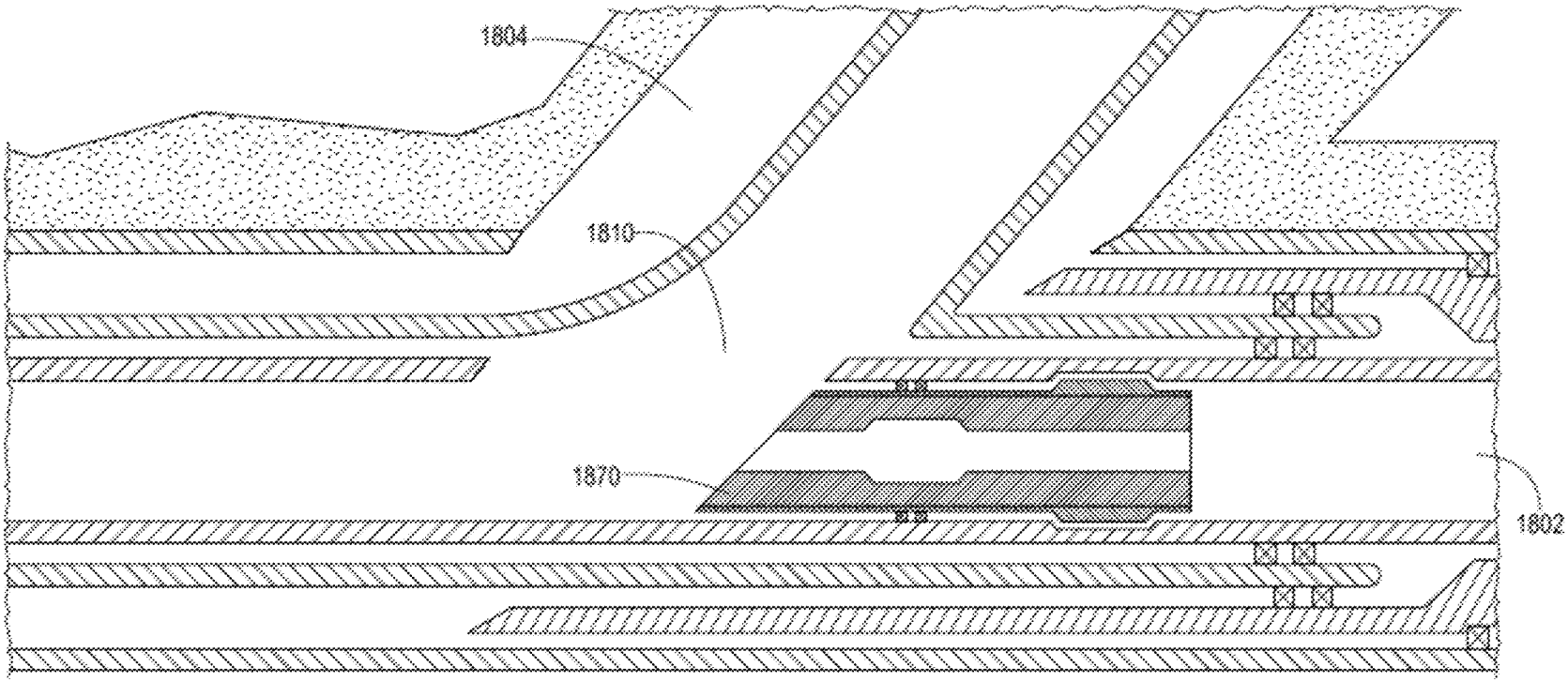
FIG. 18 is a cross-sectional view of an embodiment where the isolation sleeve can be shifted out of the way (or retrieved) and a deflection device installed to aid in deflecting one or more tools or devices out into a lateral bore, according to some embodiments.

FIG. 18 is a cross-sectional view of an embodiment where the isolation sleeve can be shifted out of the way (or retrieved) and a deflection device installed to aid in deflecting one or more tools or devices out into a lateral bore, according to some embodiments. FIG. 18 depicts a main bore 1802 and a lateral bore 1804 that is formed off the main bore 1802 at the junction 1810. An isolation sleeve 1870 may be shifted out of the way (or retrieved) to allow for a deflection device to be installed to aid in deflecting one or more tools or devices out into the lateral bore 1804.

Figure 19:
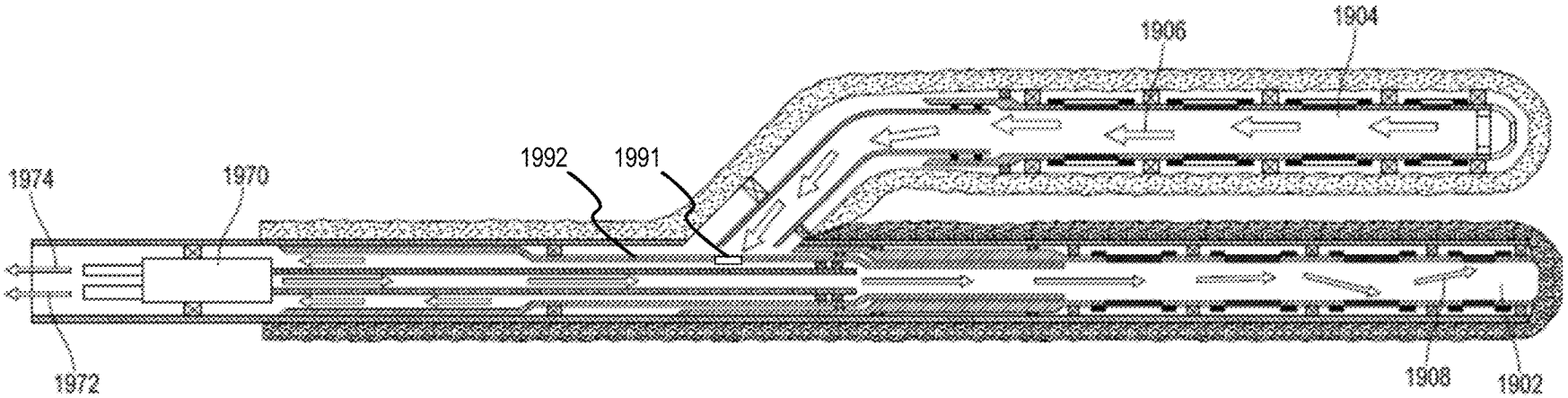
FIG. 19 is a cross-sectional view of a multilateral tool embodiment of one or more DOWSS (Downhole Oil Water Solids Separation) embodiments with a non-Level 5 junction, according to some embodiments.

FIG. 19 is a cross-sectional view of a multilateral tool embodiment of one or more DOWSS embodiments with a non-Level 5 junction, according to some embodiments. In this example, the multilateral well is producing from a lateral bore 1904 (instead of the main bore 1902) so the earthen junction isn't over-pressure by fluid being injected in its surroundings. Formation fluid 1906 is being produced from a subsurface formation surrounding the lateral bore 1904. A tubular 1992 in the main bore may include a port 1991 to enable the flow of the formation fluid 1906 to flow into the main bore. A DOWSS 1970 may receive the formation fluid 1906 and separate the formation fluid 1906 into a nonproduction fluid 1908, a sediment 1972, and a production fluid 1974. As shown, the nonproduction fluid 1908 may be disposed of downhole by being transported into the main bore 1902 for disposal in the surrounding subsurface formation. The sediment 1972 may be disposed of downhole and/or transported to the surface of the multilateral well. The production fluid 1974 may be transported to the surface of the multilateral well.

The above examples of junctions are provided as non-limiting examples—as other type of junctions may be used. The placement of the DOWSS, the DOWSS components, the tubing/fluid paths are also non-limiting examples—as other placements, components, paths may be used. The terms "downhole" and "below" may or may not be considered equivalent depending on the type of wellbore. For example, "downhole" and "below" may be considered the same for vertical wellbores. However, "downhole" and "below" may be considered different for horizontal wellbores.

Example Subsea DOWSS (Downhole Oil Water Solids Separation)

Example implementations may include Subsea Oil Water Solids Separation (SOWSS). Example implementations may include disposal of solids, storage of water, and oil maybe subsea—on the seafloor or in storage wells or in storage vessels embedded in or sitting on the seafloor (or combination of both).

Figure 20:
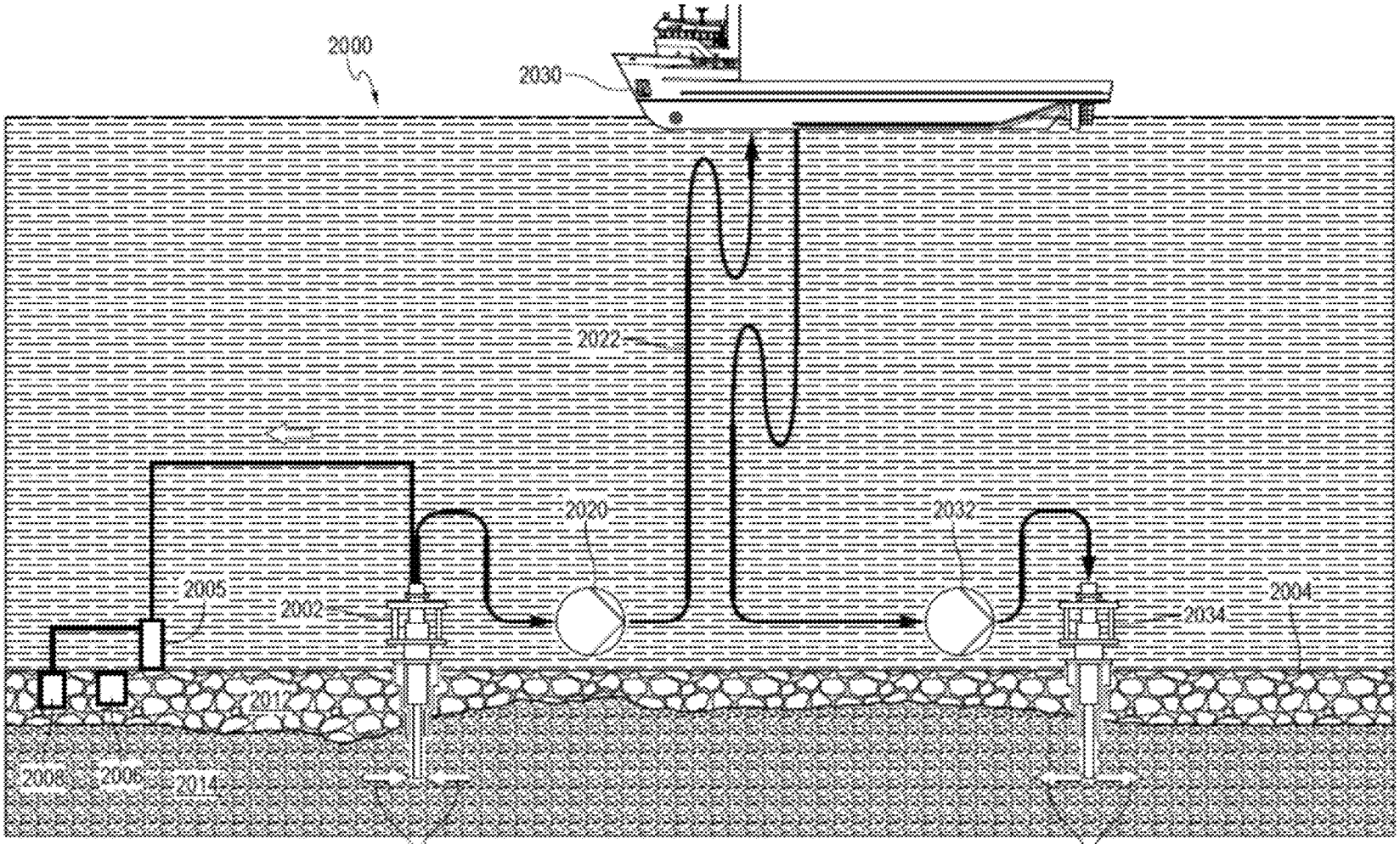
FIG. 20 is a perspective view of a first example subsea DOWSS, according to some embodiments.

FIG. 20 is a perspective view of a first example subsea DOWSS, according to some embodiments. FIG. 20 includes a subsea DOWSS 2000 that includes a subsea production well 2002 formed in a subsea surface 2004. The subsea production well 2002 may be formed through rock 2012 and a reservoir 2014. As described herein, production fluid (such as hydrocarbons 2015) and possibly nonproduction fluid, sediment, etc. may be transported from downhole to a surface of the subsea production well 2002.

In some implementations, this fluid transported to the surface of the subsea production well 2002 may be transported to a ship 2030 via a multiphase pump 2020 and risers 2022. The ship 2030 may include equipment to separate out nonproduction fluid (such as water) from the production fluid. The ship 2030 may also include storage for the production fluid. As shown, the nonproduction fluid (such as water) separated out from the production fluid by equipment of the ship 2030 may be transported down below to a subsea injection well 2034 via a water injection pump 2032. The water 2042 may be pumped downhole into the subsea injection well 2034. As shown, the water 2042 may be returned for storage in the reservoir 2014. Water injected into an oil reservoir may be done to either pressurize the reservoir to encourage the fluid to flow to the low pressure area (near the well 2002).

In some implementations, at least some of the fluid transmitted to the surface of the subsea production well 2002 may remain below (instead of being transported to the ship 2030). For example, after being transported to the surface, the fluid may be transported to a location 2005 at the subsea surface 2004 for processing, separating, pumping, etc. Then, the nonproduction fluid (separated out from this fluid) may be stored below the subsea surface 2004 at a location 2008. Additionally, the production fluid (separated out from this fluid) may be stored below the subsea surface 2004 at a location 2006. In some implementations (even though not shown), sediment (solids) separated out from this fluid may be stored at or under the subsea surface 2004.

Accordingly, fluid from the subsea production well 2002 may be pumped to subsea surface 2004 for processing, temporary storage, transport, water injection to maintain reservoir pressure, water flood from the subsea injection well 2034 to push hydrocarbons to the subsea production well 2002 and/or disposal.

In some embodiments, the solids may be flowed to the sea floor and then injected into a disposal well (or other designated well). In some embodiments, the solids, non-commercial fluids, a combination of both, etc. may be produced, separated, processed, stored and then injected into the disposal well (or other designated well).

Figure 21:
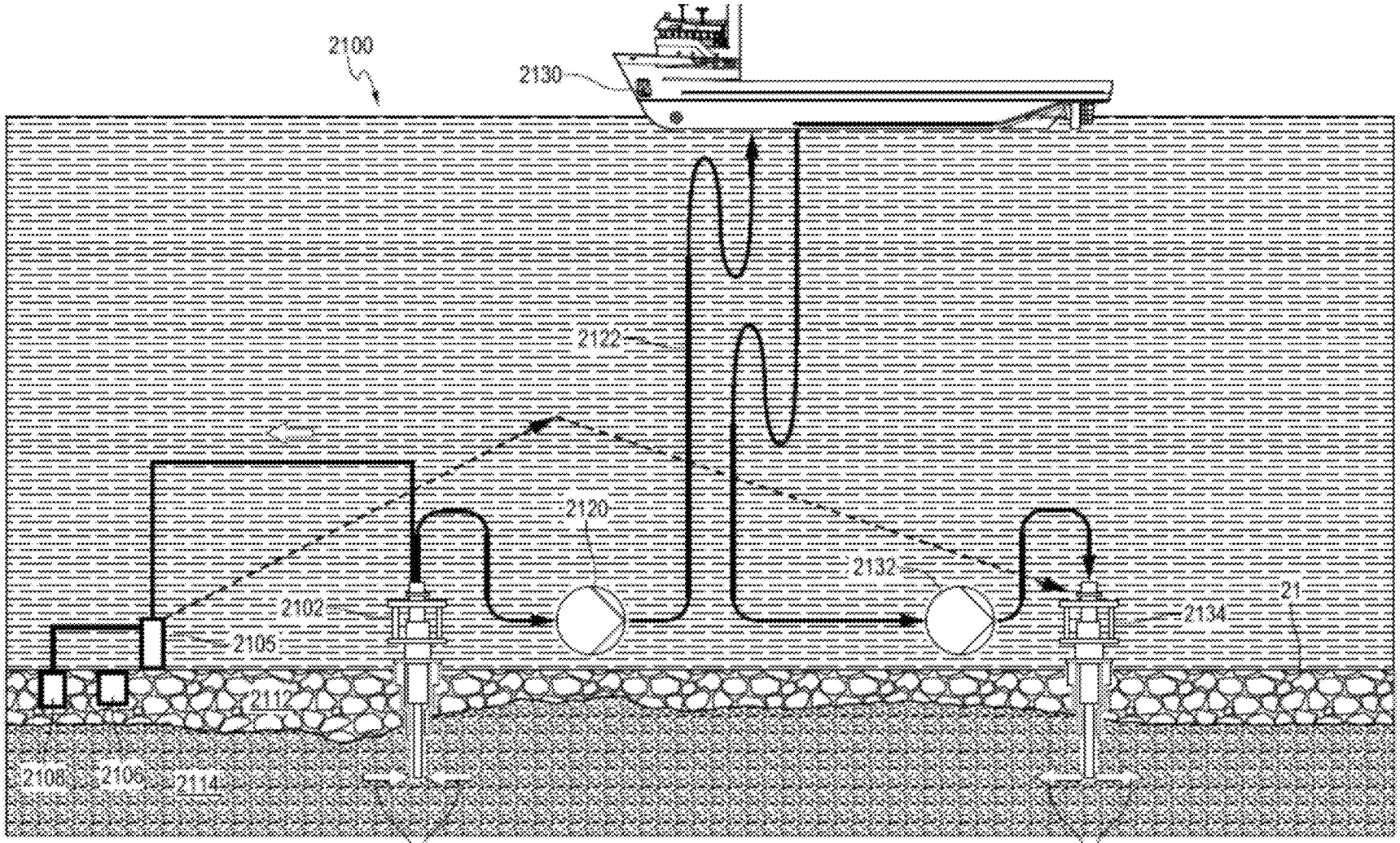
FIG. 21 is a perspective view of a second example subsea DOWSS, according to some embodiments.

To illustrate, FIG. 21 is a perspective view of a second example subsea DOWSS, according to some embodiments. Offshore drilling rigs (on occasion) inject used drilling mud into a disposal well. FIG. 21 includes a subsea DOWSS 2100 that includes a subsea disposal well 2134 used for injection of used drilling mud (solids (drill cuttings) 2142). The subsea DOWSS 2100 also includes a subsea production well 2102. As shown, the subsea disposal well 2134 and the subsea production well 2104 may be formed in a subsea surface 2104. The subsea disposal well 2134 and the subsea production well 2102 may be formed through rock 2112 and a reservoir 2114. As described herein, production fluid (such as hydrocarbons 2115) and possibly nonproduction fluid, sediment, etc. may be transported from downhole to a surface of the subsea production well 2102.

In some implementations, this fluid transported to the surface of the subsea production well 2102 may be transported to a ship 2130 via a multiphase pump 2120 and risers 2122. The ship 2130 may include equipment to separate out nonproduction fluid (such as water) from the production fluid. The ship 2130 may also include storage for the production fluid. As shown, the solids (drill cuttings) separated out from the production fluid by equipment of the ship 2130 may be transported down below to the subsea injection well 2134 via a pump 2132. The solids (drill cuttings) 2142 may be pumped downhole into the subsea disposal well 2134 for storage in the reservoir 2114.

In some implementations, at least some of the fluid transmitted to the surface of the subsea production well 2102 may remain below (instead of being transported to the ship 2130). For example, after being transported to the surface, the fluid may be transported to a location 2105 at the subsea surface 2104 for processing, separating, pumping, etc. Then, the nonproduction fluid (separated out from this fluid) may be stored below the subsea surface 2104 at a location 2108. Additionally, the production fluid (separated out from this fluid) may be stored below the subsea surface 2104 at a location 2106. The solids (drill cuttings) separated out from this fluid may be stored downhole in the subsea disposal well 2134.

Figure 22:
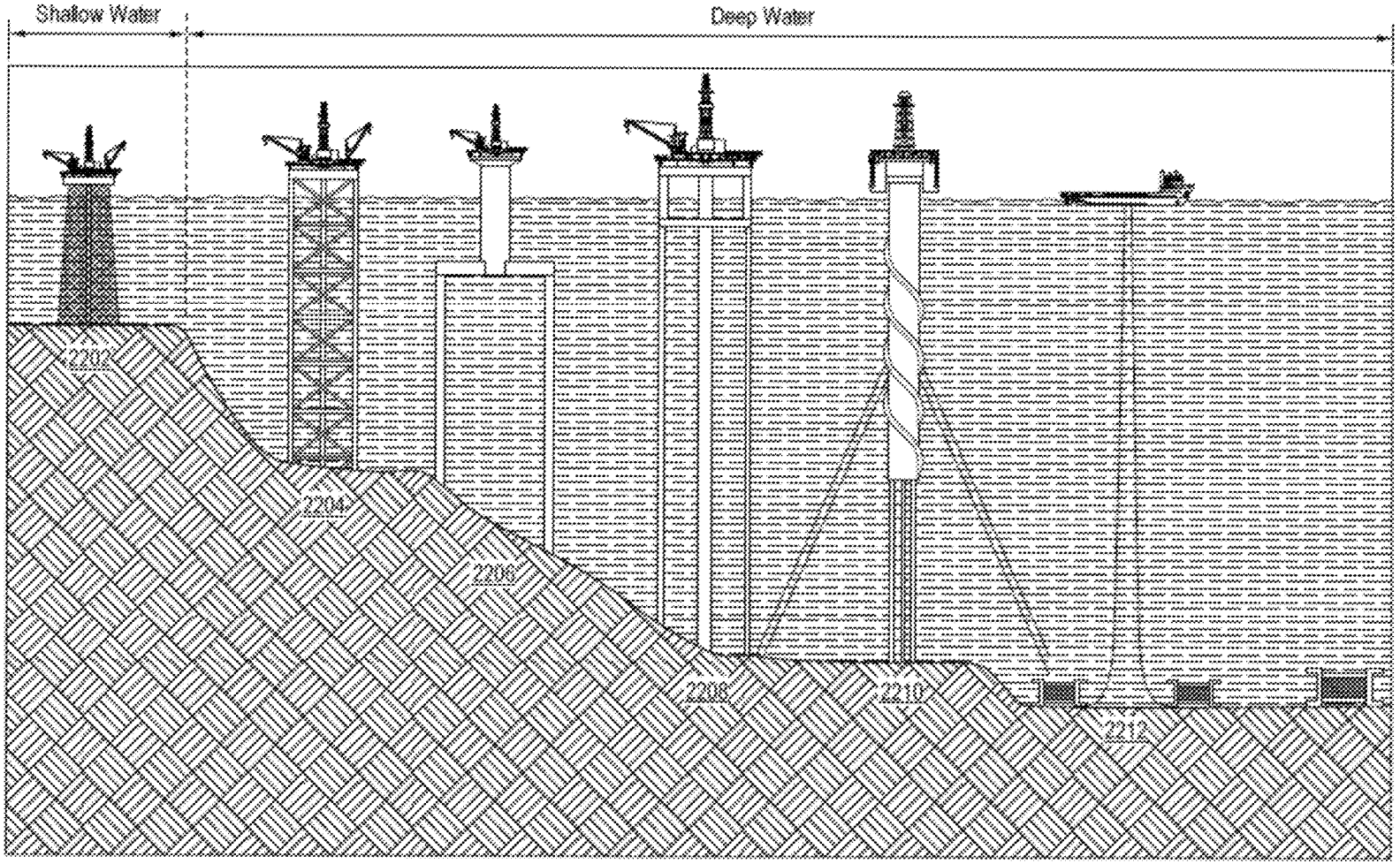
FIG. 22 is a perspective view of types of offshore wells that may benefit from example implementations, according to some embodiments.

FIG. 22 is a perspective view of types of offshore well that may benefit from example implementations, according to some embodiments. The lifting cost of producing formation water from 3000 meters (m) is very costly. The cost of lifting solids in a high-velocity rate is extremely erosive and costly. Separating out the solids and then lifting them at a slower rate will decrease the amount erosion. FIG. 22 depicts a number of offshore wells at different depths. In particular, FIG. 22 depicts a fixed platform well 2202 (that may be used up to 200 m), a compliant piled tower well 2204 (that may be used between 200-500 m), a tension leg platform (TLP) well 2206 (that may be used between 300-1500 m), a semi floating production system (FPS) well 2208 (that may be used between 300-2000 m), a single point anchor reservoir (SPAR) platform well 2210 (that may be used between 300-2000 m), and a floating production systems—(Floating Production Storage and Offloading) (FPSO) and subsea well 2212 (that may be used up to 3000 m).

Figure 23:
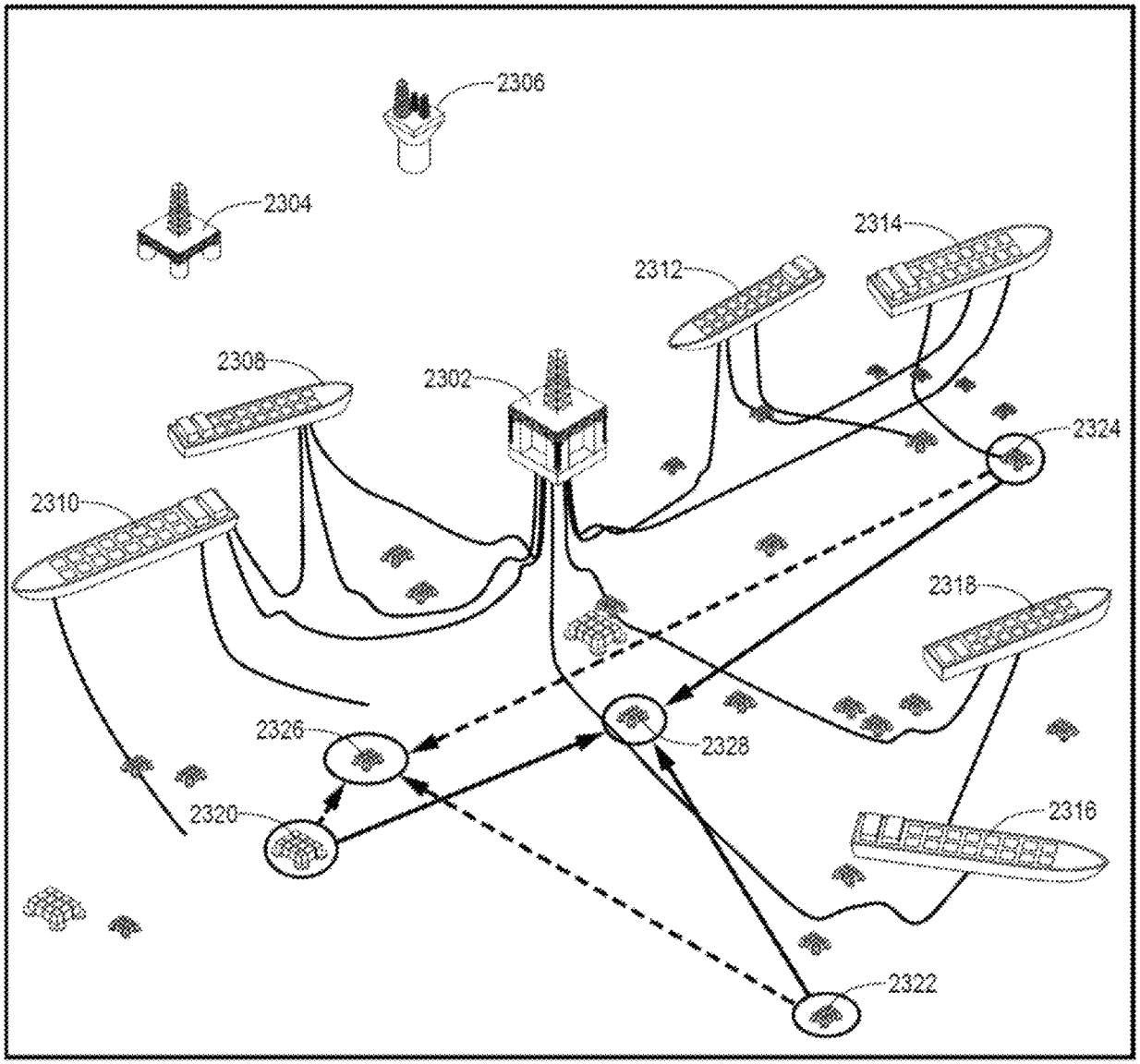
FIG. 23 is a perspective view of an example subsea downhole oil water solids separation, according to some embodiments.

FIG. 23 is a perspective view of an example subsea downhole oil water solids separation, according to some embodiments. FIG. 23 depicts a number of offshore rigs—an offshore rig 2302, an offshore rig 2304, and an offshore rig 2306. FIG. 23 also depicts a number of ships—a ship 2308, a ship 2310, a ship 2312, a ship 2314, a ship 2316, and a ship 2318. The offshore rigs 2302-2306 and the ships 2308-2318 may include equipment to separate out nonproduction fluid (such as water) from the production fluid. The offshore rigs 2302-2306 and the ships 2308-2318 may also include storage for the production fluid, the nonproduction fluid, etc.

FIG. 23 also depicts a number of production wells—a production well 2320, a production well 2322, and a production well 2324. FIG. 23 also depicts a water disposal well 2326 and a solids disposal well 2328. The fluids/solids from the production wells 2320-2324 may be transported to any of the oil rigs 2302-2306, any of the ships 2308-2318 or another subsurface well. For example, the nonproduction fluid and the solids from the production wells 2320-2324 may be transported to the water disposal well 2326 and the solids disposal well 2328, respectively. Additionally, production fluid processing and separation, nonproduction fluid processing and/or solids processing may occur at one of more of the locations identified in FIG. 23.

Figure 24:
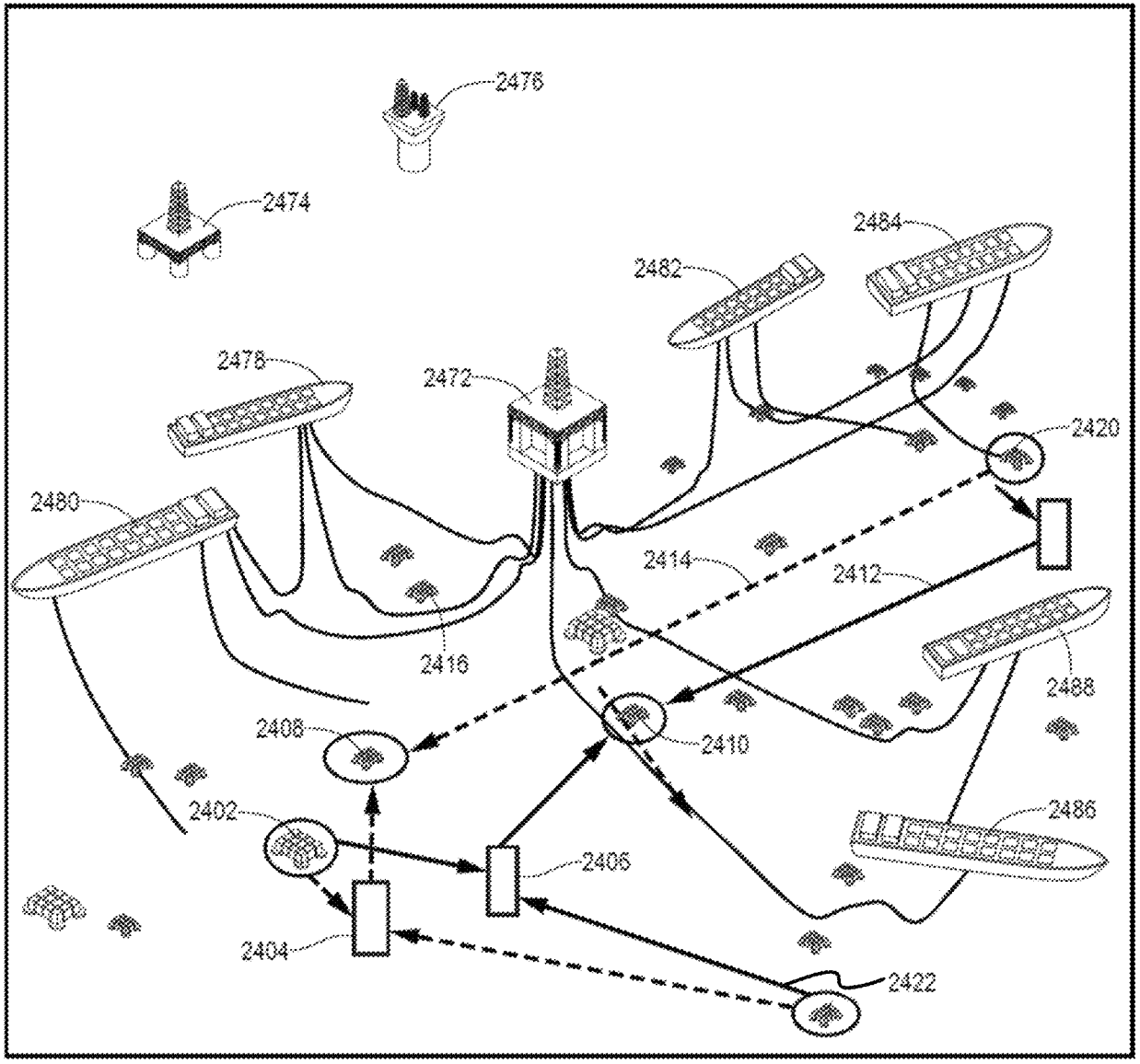
FIG. 24 is a perspective view of example locations in which example embodiments may be used.

FIG. 24 is a perspective view of example locations in which example embodiments may be used. FIG. 24 includes 11 example locations. A first example location includes a well 2402 where fluids may exit the well or are injected therein. A second example location includes an oil-cut processing unit 2404. For example, a flow diverter may divert oil-cut fluid to an oil-cut processing unit 2404. The oil-cut processing unit 2404 may include a flow diverter to remove more water from an oil-cut fluid. In some implementations, a flow diverter may divert solids, slurry, sludge, etc. to a processing unit 2406. Such solids, slurry, sludge, etc. may then be stored in a storage container or disposal well 2410. Flow diverter may be part of the storage container or disposal well 2410 to remove more oil from the slurry. The solids processing unit 2406 may include a flow diverter to remove more oil from the slurry.

FIG. 24 also depicts a number of offshore rigs—an offshore rig 2472, an offshore rig 2474, and an offshore rig 2476. FIG. 24 also depicts a number of ships—a ship 2478, a ship 2480, a ship 2482, a ship 2484, a ship 2486, and a ship 2488. The offshore rigs 2472-2476 and the ships 2478-2488 may include equipment to separate out nonproduction fluid (such as water) from the production fluid. The offshore rigs 2472-2476 and the ships 2478-2488 may also include storage for the production fluid, the nonproduction fluid, etc.

Another example location may include an oil storage and transfer unit 2408. Another example location may include a solids or slurry transfer line 2412. For example, a flow diverter may help mix, remix, stir, or agitate solids to keep them in suspension in the solids or transfer line 2412. Another example location may include a production fluids/oil-cut fluid/fluid transfer line 2414. For example, a flow diverter may help mix, remix, stir, or agitate solids and the fluids to keep them flowing properly in the production fluids/oil-cut fluid/fluid transfer line 2414. Another example location may include a well 2416 with vertical, inclined, sloped, deviated, tortuous paths.

Another example location may include a multilateral well 2418 (that includes a lateral wellbore, junction, etc.). Another example location may include a horizontal well 2420. Another example location may include a main production transfer line 2422 to another subsea pumping, gathering, and/or processing station or to land-based pumping, gathering, and/or processing facility.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE EMBODIMENTS

Example embodiments are now described.

Embodiment #1: A system for downhole separation of at least one of fluids or solids, the system comprising: a fluid flow diverter to be positioned downhole in a well, the fluid flow diverter configured to receive a formation fluid in a multilayer flow structure that comprises a production fluid and a nonproduction fluid, wherein the fluid flow diverter is configured to separate the production fluid and the nonproduction fluid by being adjusted such that more of the production fluid is above the fluid flow diverter than below the fluid flow diverter and such that more of the nonproduction fluid is below the fluid flow diverter than above the fluid flow diverter.

Embodiment #2: The system of Embodiment #1, wherein the well comprises a multi-bore well, wherein the formation fluid is to be received from a subsurface formation surrounding a first bore of the multi-bore well, and wherein the system comprises, a first pump configured to pump the nonproduction fluid into a second bore of the multi-bore well for disposal into the subsurface formation surrounding the second bore.

Embodiment #3: The system of any of Embodiments #1-2, further comprising a second pump configured to pump the production fluid to a surface of the multi-bore well.

Embodiment #4: The system of any of Embodiments #1-3, further comprising: at least one solids separator configured to separate out at least a portion of the solids from the nonproduction fluid; and at least one solids injector configured to inject the solids separated out from the nonproduction fluid into a downhole disposal location.

Embodiment #5: The system of any of Embodiments #1-4, wherein the downhole disposal location comprises the subsurface formation surrounding a third bore of the multi-bore well.

Embodiment #6: The system of any of Embodiments #1-5, wherein the fluid flow diverter is filled with a filler fluid having a density that is at least substantially the same as a density of the production fluid.

Embodiment #7: The system of any of Embodiments #1-6, wherein the fluid flow diverter comprises a tank with walls having a thickness at least greater than a thickness to withstand hydrostatic pressures downhole in the well.

Embodiment #8: The system of any of Embodiments #1-7, wherein the fluid flow diverter is composed of material to withstand a downhole temperature in the well of at least 65.5 Celsius (C), up to 93.3 C, up to 121 C, up to 149 C, or at least 177 C.

Embodiment #9: The system of any of Embodiments #1-8, wherein the fluid flow diverter comprises sealed components.

Embodiment #10: The system of any of Embodiments #1-9, wherein the fluid flow diverter is filled with a filler fluid having a density that is lower than the density of the production fluid, such that the combined weight of diverter and the filler fluid is less than the weight of the nonproduction fluid, and such that the combined weight of the fluid flow diverter and the filler fluid is greater than the weight of production fluid.

Embodiment #11: The system of any of Embodiments #1-10, further comprising: a controller configured to adjust the fluid flow diverter such that more of the production fluid is above the fluid flow diverter than below the fluid flow diverter and such that more of the nonproduction fluid is below the fluid flow diverter than above the fluid flow diverter based on at least one of a viscosity or density of at least one of the formation fluid, the production fluid, or the nonproduction fluid.

Embodiment #12: The system of any of Embodiments #1-11, further comprising: a sensor to be positioned in a fluid flow of at least one of the formation fluid, the production fluid, or the nonproduction fluid to sense of the at least one of the viscosity or density of the formation fluid, the production fluid, or the nonproduction fluid, wherein the controller is configured to adjust the fluid flow diverter based on the sensing by the sensor.

Embodiment #13: The system of any of Embodiments #1-12, further comprising: a production fluid sensor to be positioned in the proximity of flow of the production fluid to sense the at least one of the viscosity or the density of the production fluid, wherein the controller is configured to adjust the fluid flow diverter based on the sensing by the production fluid sensor.

Embodiment #14: The system of any of Embodiments #1-13, wherein at least one of the production fluid sensor is downhole in the well.

Embodiment #15: The system of any of Embodiments #1-14, further comprising: a nonproduction fluid sensor to be positioned in the proximity of a flow of the nonproduction fluid to sense the at least one of the viscosity or density of the nonproduction fluid, wherein the controller is configured to adjust the fluid flow diverter based on the sensing by the nonproduction fluid sensor.

Embodiment #16: The system of any of Embodiments #1-15, wherein the nonproduction fluid sensor is downhole in the well.

Embodiment #17: The system of any of Embodiments #1-16, wherein the fluid flow diverter is to be adjusted such that more hydrocarbons are above the fluid flow diverter than below the fluid flow diverter.

Embodiment #18: The system of any of Embodiments #1-17, wherein the fluid flow diverter is to be adjusted such that more water is below the fluid flow diverter than above the fluid flow diverter.

Embodiment #19: The system of any of Embodiments #1-18, further comprising: a sediment separator to be positioned downhole in the well, wherein the sediment separator is configured to receive the nonproduction fluid output from the fluid flow diverter, the sediment separator configured to separate out sediment from the nonproduction fluid, wherein the nonproduction fluid is to be injected into a subsurface formation surrounding a second bore of the well.

Embodiment #20: The system of any of Embodiments #1-19, wherein the formation fluid comprises immiscible fluid.

Embodiment #21: The system of any of Embodiments #1-20, wherein the fluid flow diverter is adjustable such that hydrocarbons flow across the fluid flow diverter in substantially equal amounts in an azimuthal orientation along an axis of the well.

Embodiment #22: The system of any of Embodiments #1-21, wherein the fluid flow diverter comprises coalescing-type features.

Embodiment #23: The system of any of Embodiments #1-22, wherein the fluid flow diverter comprises a replaceable fluid flow diverter.

Embodiment #24: The system of any of Embodiments #1-23, wherein the fluid flow diverter is configurable to allow for a tool to pass through, over, or under the fluid flow diverter without damaging the fluid flow diverter or the tool.

Embodiment #25: A method comprising: introducing a formation fluid from a subsurface formation into a well formed in the subsurface formation; separating the formation fluid into two separate flows via a fluid flow diverter; and adjusting a position of the fluid flow diverter a flow of the formation fluid such that more production fluid is above the fluid flow diverter than below the fluid flow diverter and such that more nonproduction fluid is below the fluid flow diverter than above the fluid flow diverter.

Embodiment #26: The method of Embodiment #25, wherein the fluid flow diverter is substantially horizontal or configurable to become substantially horizontal.

Embodiment #27: The method of any of Embodiments #25-26, wherein introducing the formation fluid from the subsurface formation comprises introducing the formation fluid from the subsurface formation into a downhole oil and water separation system positioned in the well and that comprises the fluid flow diverter.

Embodiment #28: The method of any of Embodiments #25-27, further comprising: transporting the production fluid to a surface of the well.

Embodiment #29: The method of any of Embodiments #25-28, further comprising: transporting the nonproduction fluid to a different location downhole in the well for storage or disposal in the subsurface formation.

Embodiment #30: The method of any of Embodiments #25-29, wherein the well comprises a multi-bore well, wherein introducing the formation fluid from the subsurface formation into the well formed in the subsurface formation comprises introducing the formation fluid to a different location from the subsurface formation surrounding a first bore of the multi-bore well; wherein the different location is a second bore of the multi-bore well.

Embodiment #31: The method of any of Embodiments #25-30, wherein adjusting the position of the fluid flow diverter comprises, adjusting the position of the fluid flow diverter the flow of the formation fluid such that more hydrocarbons are in a flow above the fluid flow diverter than are below the fluid flow diverter; and adjusting the position of the fluid flow diverter the flow of the formation fluid such that more water in a flow below the fluid flow diverter than is above the fluid flow diverter.

Embodiment #32: The method of any of Embodiments #25-31, wherein the position of the fluid flow diverter is based upon at least one of one or more densities of fluid flow, a difference in densities between fluid flows, a property of the formation fluid, a property of the production fluid, a property of the nonproduction fluid, or a collapse resistance of a buoyance tank of the fluid flow diverter.

Embodiment #33: The method of any of Embodiments #25-32, wherein adjusting of the position of the fluid flow diverter comprises, adjusting the position of the fluid flow diverter is managed by a controller and sensor.

The invention claimed is:

1. A system for downhole separation of at least one of fluids or solids, the system comprising:

a fluid flow diverter to be positioned downhole in a well, the fluid flow diverter configured to receive a formation fluid in a multilayer flow structure that comprises a production fluid and a nonproduction fluid, wherein the fluid flow diverter is configured to separate the production fluid and the nonproduction fluid by self-adjusting a position of the fluid flow diverter due to a density-determined change in buoyancy of the fluid flow diverter, such that more of the production fluid is above the fluid flow diverter than below the fluid flow diverter and such that more of the nonproduction fluid is below the fluid flow diverter than above the fluid flow diverter.

2. The system of claim 1, wherein the well comprises a multi-bore well, wherein the formation fluid is to be received from a subsurface formation surrounding a first bore of the multi-bore well, and wherein the system comprises, a first pump configured to pump the nonproduction fluid into a second bore of the multi-bore well for disposal into the subsurface formation surrounding the second bore.

3. The system of claim 2, further comprising a second pump configured to pump the production fluid to a surface of the multi-bore well.

4. The system of claim 2, further comprising:

at least one solids separator configured to separate out at least a portion of the solids from the nonproduction fluid; and at least one solids injector configured to inject the solids separated out from the nonproduction fluid into a downhole disposal location.

5. The system of claim 4, wherein the downhole disposal location comprises the subsurface formation surrounding a third bore of the multi-bore well.

6. The system of claim 1, wherein the fluid flow diverter is filled with a filler fluid having a density that is at least substantially the same as a density of the production fluid.

7. The system of claim 6, wherein the fluid flow diverter comprises a tank with walls having a thickness at least greater than a thickness to withstand hydrostatic pressures downhole in the well.

8. The system of claim 6, wherein the fluid flow diverter is composed of material to withstand a downhole temperature in the well of at least 65.5 Celsius (C), up to 93.3 C, up to 121 C, up to 149 C, or at least 177 C.

9. The system of claim 6, wherein the fluid flow diverter comprises sealed components.

10. The system of claim 1, wherein the fluid flow diverter is filled with a filler fluid having a density that is lower than the density of the production fluid, such that the combined weight of diverter and the filler fluid is less than the weight of the nonproduction fluid, and such that the combined weight of the fluid flow diverter and the filler fluid is greater than the weight of production fluid.

11. The system of claim 1, further comprising:

a controller configured to adjust the fluid flow diverter such that more of the production fluid is above the fluid flow diverter than below the fluid flow diverter and such that more of the nonproduction fluid is below the fluid flow diverter than above the fluid flow diverter based on at least one of a viscosity or density of at least one of the formation fluid, the production fluid, or the nonproduction fluid.

12. The system of claim 11, further comprising:

a sensor to be positioned in a fluid flow of at least one of the formation fluid, the production fluid, or the nonproduction fluid to sense of the at least one of the viscosity or density of the formation fluid, the production fluid, or the nonproduction fluid, wherein the controller is configured to adjust the fluid flow diverter based on the sensing by the sensor.

13. The system of claim 11, further comprising:

a production fluid sensor to be positioned in the proximity of flow of the production fluid to sense the at least one of the viscosity or the density of the production fluid, wherein the controller is configured to adjust the fluid flow diverter based on the sensing by the production fluid sensor.

14. The system of claim 13, wherein at least one of the production fluid sensor is downhole in the well.

15. The system of claim 11, further comprising:

a nonproduction fluid sensor to be positioned in the proximity of a flow of the nonproduction fluid to sense the at least one of the viscosity or density of the nonproduction fluid, wherein the controller is configured to adjust the fluid flow diverter based on the sensing by the nonproduction fluid sensor.

16. The system of claim 15, wherein the nonproduction fluid sensor is downhole in the well.

17. The system of claim 1, wherein the fluid flow diverter is to be adjusted such that more hydrocarbons are above the fluid flow diverter than below the fluid flow diverter.

18. The system of claim 17, wherein the fluid flow diverter is to be adjusted such that more water is below the fluid flow diverter than above the fluid flow diverter.

19. The system of claim 1, further comprising:

a sediment separator to be positioned downhole in the well, wherein the sediment separator is configured to receive the nonproduction fluid output from the fluid flow diverter, the sediment separator configured to separate out sediment from the nonproduction fluid, wherein the nonproduction fluid is to be injected into a subsurface formation surrounding a second bore of the well.

20. The system of claim 1, wherein the formation fluid comprises immiscible fluid.

21. The system of claim 1, wherein the fluid flow diverter is adjustable such that hydrocarbons flow across the fluid flow diverter in substantially equal amounts in an azimuthal orientation along an axis of the well.

22. The system of claim 1, wherein the fluid flow diverter comprises coalescing-type features.

23. The system of claim 1, wherein the fluid flow diverter comprises a replaceable fluid flow diverter.

24. The system of claim 1, wherein the fluid flow diverter is configurable to allow for a tool to pass through, over, or under the fluid flow diverter without damaging the fluid flow diverter or the tool.

25. A method comprising:

introducing a formation fluid from a subsurface formation into a well formed in the subsurface formation;

separating the formation fluid into two separate flows via a fluid flow diverter; and adjusting a position of the fluid flow diverter a flow of the formation fluid such that more production fluid is above the fluid flow diverter than below the fluid flow diverter and such that more nonproduction fluid is below the fluid flow diverter than above the fluid flow diverter by self-adjusting the position of the fluid flow diverter due to a density-determined change in buoyancy of the fluid flow diverter.

26. The method of claim 25, wherein the fluid flow diverter is substantially horizontal or configurable to become substantially horizontal.

27. The method of claim 25, wherein introducing the formation fluid from the subsurface formation comprises introducing the formation fluid from the subsurface formation into a downhole oil and water separation system positioned in the well and that comprises the fluid flow diverter.

28. The method of claim 25, further comprising:

transporting the production fluid to a surface of the well.

29. The method of claim 28, further comprising:

transporting the nonproduction fluid to a different location downhole in the well for storage or disposal in the subsurface formation.

30. The method of claim 29, wherein the well comprises a multi-bore well, wherein introducing the formation fluid from the subsurface formation into the well formed in the subsurface formation comprises introducing the formation fluid to a different location from the subsurface formation surrounding a first bore of the multi-bore well;

wherein the different location is a second bore of the multi-bore well.

31. The method of claim 25, wherein adjusting the position of the fluid flow diverter comprises, adjusting the position of the fluid flow diverter the flow of the formation fluid such that more hydrocarbons are in a flow above the fluid flow diverter than are below the fluid flow diverter; and adjusting the position of the fluid flow diverter the flow of the formation fluid such that more water in a flow below the fluid flow diverter than is above the fluid flow diverter.

32. The method of claim 31, wherein the position of the fluid flow diverter is based upon at least one of one or more densities of fluid flow, a difference in densities between fluid flows, a property of the formation fluid, a property of the production fluid, a property of the nonproduction fluid, or a collapse resistance of a buoyance tank of the fluid flow diverter.

33. The method of claim 32, wherein adjusting of the position of the fluid flow diverter comprises, adjusting the position of the fluid flow diverter is managed by a controller and sensor.

* * * * *